US007591545B2

(12) United States Patent
Iwasaki et al.

(10) Patent No.: US 7,591,545 B2
(45) Date of Patent: Sep. 22, 2009

(54) LIQUID APPLICATION DEVICE AND INKJET RECORDING APPARATUS

(75) Inventors: Osamu Iwasaki, Tokyo (JP); Naoji Otsuka, Yokohama (JP); Yoshinori Nakagawa, Kawasaki (JP); Atsuhiko Masuyama, Tokyo (JP); Naomi Oshio, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 11/463,442

(22) Filed: Aug. 9, 2006

(65) Prior Publication Data

US 2007/0035593 A1 Feb. 15, 2007

(30) Foreign Application Priority Data

Aug. 11, 2005 (JP) ..... 2005-233272

(51) Int. Cl.
*B41J 2/17* (2006.01)

(52) U.S. Cl. ..... 347/84

(58) Field of Classification Search ..... None
See application file for complete search history.

(56) References Cited

U.S. PATENT DOCUMENTS

| | | | | |
|---|---|---|---|---|
| 5,850,233 | A | 12/1998 | Otsuka et al. | 346/136 |
| 6,012,809 | A * | 1/2000 | Ikeda et al. | 347/101 |
| 6,142,600 | A | 11/2000 | Takahashi | 347/23 |
| 6,283,585 | B1 * | 9/2001 | Ikkatai et al. | 347/85 |
| 2005/0110856 | A1 * | 5/2005 | Mouri et al. | 347/103 |
| 2005/0174380 | A1 | 8/2005 | Ide et al. | 347/19 |
| 2005/0179720 | A1 | 8/2005 | Iwasaki et al. | 347/19 |
| 2006/0061638 | A1 * | 3/2006 | Amarume et al. | 347/84 |
| 2006/0176325 | A1 | 8/2006 | Seki et al. | 347/7 |
| 2007/0034102 | A1 | 2/2007 | Oshio et al. | 101/348 |
| 2007/0034152 | A1 | 2/2007 | Nakagawa et al. | 118/679 |
| 2007/0035592 | A1 | 2/2007 | Oshio et al. | 347/84 |
| 2007/0070163 | A1 | 3/2007 | Masuyama et al. | 347/104 |

(Continued)

FOREIGN PATENT DOCUMENTS

| | | |
|---|---|---|
| JP | 6-246902 | 9/1994 |

(Continued)

OTHER PUBLICATIONS

Machine translation of JP 06-246902 A and JP 2001-232807 A.*

(Continued)

*Primary Examiner*—Matthew Luu
*Assistant Examiner*—Justin Seo
(74) *Attorney, Agent, or Firm*—Fitzpatrick, Cella, Harper & Scinto

(57) ABSTRACT

In a liquid application device and an inkjet recording apparatus, even if the number of liquid storage units is increased, the number of parts can be reduced, and cost reduction and miniaturization can be realized. The liquid application device includes a buffer tank storing application liquid to be supplied to a space-creating base. Additionally, the device includes an exchange tank storing application liquid to be refilled in the buffer tank. Moreover, the device includes first and second channels linking the buffer tank and the space-creating base, a pump arranged in the second channel, and a third channel linking a T-shaped channel and an exchange tank. Furthermore, the device includes a first valve which switches shutoff and link between first and second tubes, and a third valve which switches shutoff and link between third and fourth tubes.

10 Claims, 24 Drawing Sheets

U.S. PATENT DOCUMENTS

| | | | | |
|---|---|---|---|---|
| 2007/0126835 | A1 | 6/2007 | Oshio et al. | 347/103 |
| 2007/0126836 | A1 | 6/2007 | Masuyama et al. | 347/103 |

FOREIGN PATENT DOCUMENTS

| | | | |
|---|---|---|---|
| JP | 8-58069 | | 3/1996 |
| JP | 11105303 | A * | 4/1999 |
| JP | 2001-232807 | | 8/2001 |
| JP | 2002-96452 | | 4/2002 |

OTHER PUBLICATIONS

Machine translation of detailed description and description of drawings for JP 11-105303 A.*

* cited by examiner

LIQUID APPLICATION DEVICE AND INKJET RECORDING APPARATUS

BACKGROUND OF THE INVENTION

1. Field of the Invention

The present invention relates to a liquid application device and an inkjet recording apparatus, and particularly to a liquid application device for applying liquid to a medium for a certain purpose which is, for example, to promote the coagulation of pigment when recording is carried out using an ink which contains the pigment as a coloring material. The present invention also relates particularly to an inkjet recording apparatus which includes a mechanism for applying liquid to a recording medium used in inkjet recording, for a purpose which is, for example, to promote the coagulation of pigment when recording is carried out using an ink containing the pigment as a coloring material.

2. Description of the Related Art

In the field of printing, there has been conventionally known a gravure printing machine having a configuration where an area in which ink as application liquid is applied or supplied to a roller having a print pattern of a printing plate formed on a surface thereof (Japanese Patent Application Laid-open No. Hei 08-58069 A), is sealed off. In this machine, an ink chamber having two doctor blades is caused to abut the circumferential surface of the roller, thereby forming an ink room (an ink reservoir) between the chamber and the roller.

Additionally, means for supplying application liquid to an application mechanism of application liquid using a closed space as is disclosed in Japanese Patent Application Laid-open No. Hei 08-58069 A, is disclosed in Japanese Patent Application Laid-open No. Hei 06-246902 A. In Japanese Patent Application Laid-open No. Hei 06-246902 A, the application liquid is circulated by using a pump in a circuit where an application mechanism, and application liquid storage means which stores the application liquid are connected via two channels. In the configuration of this document, the above pump is arranged downstream of the application mechanism (in the collection channel of the channels connecting the application mechanism and the application liquid storage means). With this configuration, the internal pressure in the application mechanism keeps not higher than the atmospheric pressure, whereby liquid leakage in the application mechanism can be prevented. Furthermore, in the configuration of the same document, a valve, used for switching communication with the atmosphere and communication with the application liquid storage means, is arranged upstream of the application mechanism in the circuit for the circulation. With this valve, it is made possible to collect the application liquid inside the application mechanism. This collection operation makes possible the prevention of the application liquid leakage which may occur when a device, not in use, including the application mechanism is carried around.

On the other hand, in the field of inkjet recording, there has been known, as one configuration for supplying ink to a recording head, a configuration where first liquid storage means (a buffer tank) and second liquid storage means (a main tank) are provided (Japanese Patent Application Laid-open No. 2001-232807 A). In this configuration, the first liquid storage means (the buffer tank) is provided in a circulation supply path, and the second liquid storage means (the main tank) is linked with this first liquid storage means. This configuration using the buffer tank makes it possible to maintain a pressure in the recording head at a constant level in consideration of stable supply of the ink. That is, in the configuration of Japanese Patent Application Laid-open No. 2001-232807 A, fluctuation in pressure in the recording head is suppressed by reducing a difference in water head between a liquid surface of the ink inside the buffer tank, and the recording head for the purpose of stabilizing the applied amount of the ink.

In the configuration of Japanese Patent Application Laid-open No. 2001-232807 A, since the two above-mentioned liquid storage means, and the printing head are included, there exist two routes for supplying the ink to predetermined members, and one pump is provided to each of the two routes. Out of these pumps, a first pump is provided between the recording head and the buffer tank, and performs supply of the ink from the buffer tank to the printing head. On the other hand, a second pump is provided between the buffer tank and the main tank, and performs supply of the ink from the main tank to the buffer tank.

In a recording apparatus described in Japanese Patent Application Laid-open No. 2001-232807 A, the buffer tank and the main tank are provided for the purpose of deaeration. By this means, intrusion of air bubbles into the recording head is reduced when the ink is supplied to the recording head. Furthermore, it is also desirable that the buffer tank be provided in view of the stabilization of the application amount of the ink, as has been described above.

In Japanese Patent Application Laid-open No. 2001-232807 A, however, the first pump for supplying the ink from the buffer tank to the printing head, and additionally, the second pump for supplying the ink from the main tank to the buffer tank, are necessary. In recent years, further miniaturization and cost reduction of the apparatus have been desired. For these purposes, in a liquid application device and a recording apparatus each of which includes two liquid storage means, it is preferable that the number of parts constituting each of the device and the apparatus be reduced, the parts including such as a pump, a channel and a control unit necessitated by the pump.

SUMMARY OF THE INVENTION

An object of the present invention is to provide a liquid application device and an inkjet recording apparatus in each of which, even in a case where the number of liquid storage means is increased, the number of parts can be reduced, and thereby cost reduction and miniaturization can be realized.

In first aspect of the present invention, a liquid application device comprises: liquid application means including an application member for applying liquid to a medium, and a retention member for retaining the liquid in a liquid retention space formed in contact with the application member, wherein the liquid application means applies the liquid retained in the liquid retention space to the medium via the application member by rotating the application member; a first storage unit for holding the liquid; passage which causes the first storage unit and the retention member to communicate with each other; a pump which causes the liquid to flow in a channel including the first storage unit, the passage, and the liquid retention space; and a second storage unit for holding a liquid which is supplied to the channel; wherein the liquid held in the second storage unit is supplied to the channel by the pump.

In second aspect of the present invention, a liquid application device comprises: liquid application means including an application member for applying liquid to a medium, and a retention member for retaining the liquid in a liquid retention space formed in contact with the application member, wherein the liquid application means applies the liquid retained in the liquid retention space to the medium via the application member by rotating the application member; a first storage unit for holding the liquid; a first passage and a second passage which causes the first storage unit and the retention member to communicate with each other; a pump which is arranged in the second passage, and which causes the liquid to flow in a channel including the first storage unit, the first passage, the second passage, and the liquid retention space; a second storage unit for holding the liquid, and which is exchangeable; and a third passage which causes the second storage unit and the second passage to communicate with each other; wherein the liquid held in the second storage unit is supplied to the second passage via the third passage by the pump.

In third aspect of the present invention, an inkjet recording apparatus comprises: the liquid application device according to the first aspect of the present invention; and recording means which records an image on a medium by ejecting ink from a recording head to the medium to which the liquid has been applied by the liquid application device.

In fourth aspect of the present invention, a recording apparatus comprises: the liquid application device according to the first aspect of the present invention; and recording means which records an image on a medium by applying a recording agent to the medium to which the liquid has been applied by the liquid application device.

According to the present invention, even if a first storage means (buffer tank) and a second storage means (main tank) are arranged, necessity of increasing the number of the liquid moving means is eliminated. Consequently, the number of parts of the device and that of the apparatus can be reduced, whereby cost reduction and miniaturization thereof are made possible.

Further features of the present invention will become apparent from the following description of exemplary embodiments (with reference to the attached drawings).

BRIEF DESCRIPTION OF THE DRAWINGS

FIG. 17 is an explanatory diagram for explaining an application process proceeding between an application surface and a surface of a medium in a case where the medium P is a plain paper in the embodiment of the present invention, showing a state of the application roller and the counter roller in an area upstream of a nip area in between;

FIG. 18 is an explanatory diagram for explaining an application process proceeding between an application surface and a surface of a medium where the medium P is a plain paper in the embodiment of the present invention, showing a state of the application roller and the counter roller in the nip area in between;

FIG. 19 is an explanatory diagram for explaining an application process proceeding between an application surface and a surface of a medium in a case where the medium P is a plain paper in the embodiment of the present invention, showing a state of the application roller and the counter roller in an area downstream of a nip area in between;

DESCRIPTION OF THE EMBODIMENTS

Detailed description will be given below of a preferred embodiment of the present invention with reference to the accompanying drawings.

First Embodiment

Figure 1:
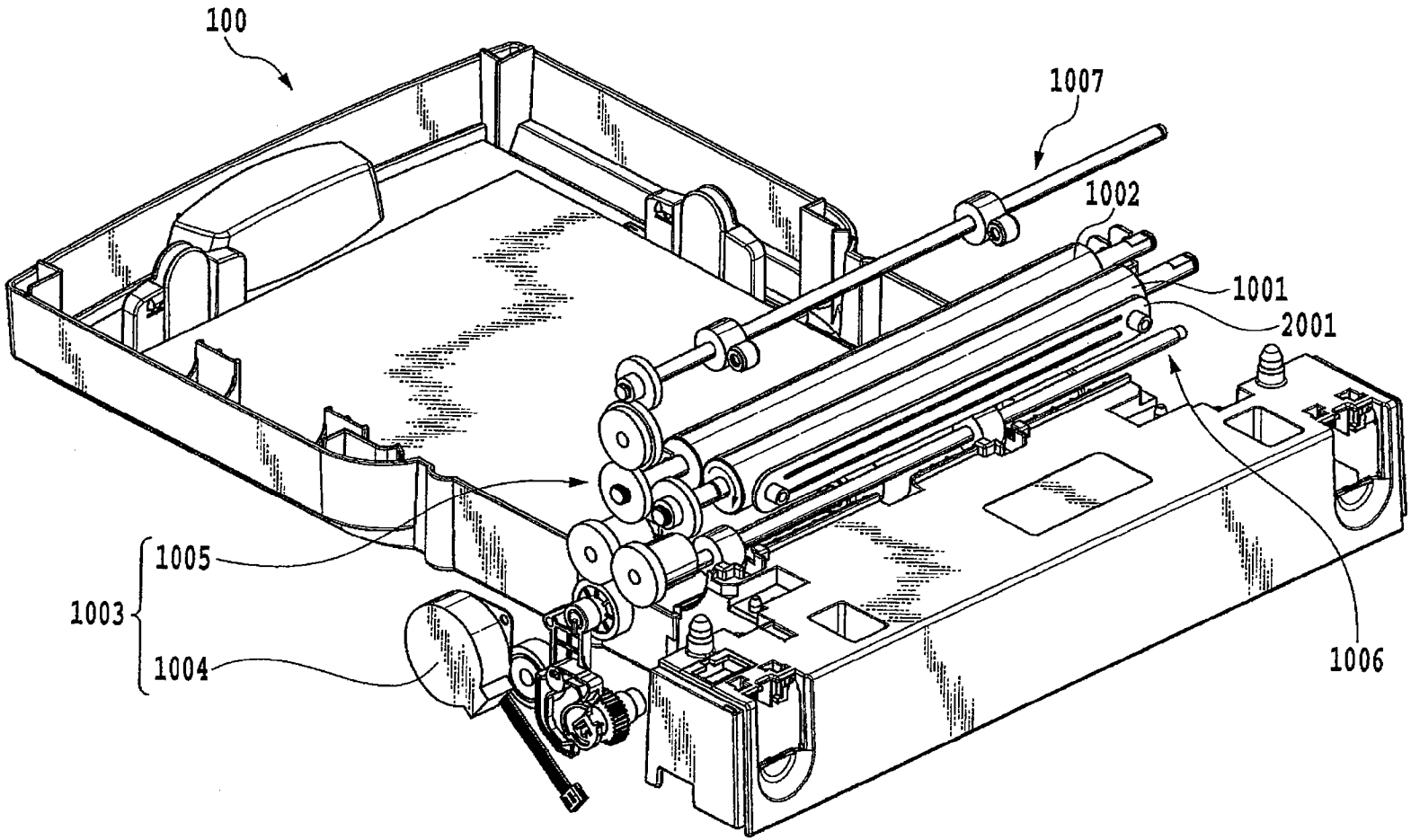
FIG. 1 is a perspective view showing an overall construction of an embodiment of a liquid application device of the present invention.

FIG. 1 is a perspective view showing an overall structure of the embodiment of a liquid application device 100 of the present invention. The liquid application device 100 shown here generally includes liquid application means for applying a predetermined application liquid to a medium (hereinafter also referred to as the application medium) which is an object to which the liquid is applied and liquid supply means for supplying the application liquid to the liquid application means.

The liquid application means includes a cylindrical application roller 1001, a cylindrical counter roller (a medium supporting member) 1002 placed so as to face the application roller 1001 and a roller drive mechanism 1003 driving the application roller 1001. The roller drive mechanism 1003 includes a roller drive motor 1004 and a power transmission mechanism 1005 including a gear train for transmitting the driving force of the roller drive motor 1004 to the application roller 1001.

The liquid supply means includes a liquid retention member 2001 retaining the application liquid between itself and a circumferential surface of the application roller 1001, and a liquid channel 3000 (not shown in FIG. 1), to be described later, supplying the liquid to the liquid retention member 2001. The application roller 1001 and the counter roller 1002 are freely rotatably supported individually by parallel shafts, each of which has both ends thereof freely rotatably fitted to a frame not shown. The liquid retention member 2001 extends substantially over the entire length of the application roller 1001, and is movably mounted to the frame via a mechanism which enables the liquid retention member 2001 to come into contact with or to separate from the circumferential surface of the application roller 1001.

The liquid application device of this embodiment further includes an application medium feeding mechanism 1006 for transferring the application medium to a nip area between the application roller 1001 and the counter roller 1002, the application medium feeding mechanism 1006 being constituted of a pickup roller and other elements. In a transfer path of the application media, a sheet discharging mechanism 1007 transferring, to a sheet discharging unit (not shown), the application medium to which the application liquid has been applied is provided downstream of the application roller 1001 and the counter roller 1002, the sheet discharging mechanism 1007 having a sheet discharging roller and other elements. As in the case of the application roller and the like, these paper feeding mechanism and the sheet discharging mechanism are operated by the driving force of the drive motor 1004 transmitted via the power transmission mechanism 1005.

It should be noted that the application liquid used in this embodiment is a liquid used for the purpose of advancing the start of the coagulation of pigment when recording is carried out using an ink which contains pigment as a coloring material.

An example of components of the application liquid is described below.

calcium nitrate tetrahydrate 10%
glycerin 42%
surface-active agent 1%
water the rest The viscosity of the application liquid is from 5 to 6 cP (centipoises) at 25° C.

Needless to say, in application of the present invention, the application liquid is not limited to the above liquid. As another application liquid, for example, a liquid which contains a component insolubilizing the dye or causing the coagulation of the dye, can be used. As yet another application liquid, a liquid which contains a component suppressing curling of the application media (the phenomenon that the media take a curved shape), can be used.

In a case where water is used in the applied liquid, the sliding property at the contact area of the liquid retention member with the application roller of the present invention will be improved by mixing a component reducing the surface tension with the liquid. In the above example of the components of the applied liquid, glycerin and the surface-active agent are the components reducing the surface tension of water.

More detailed description will now be given of construction of each portion.

Figure 2:
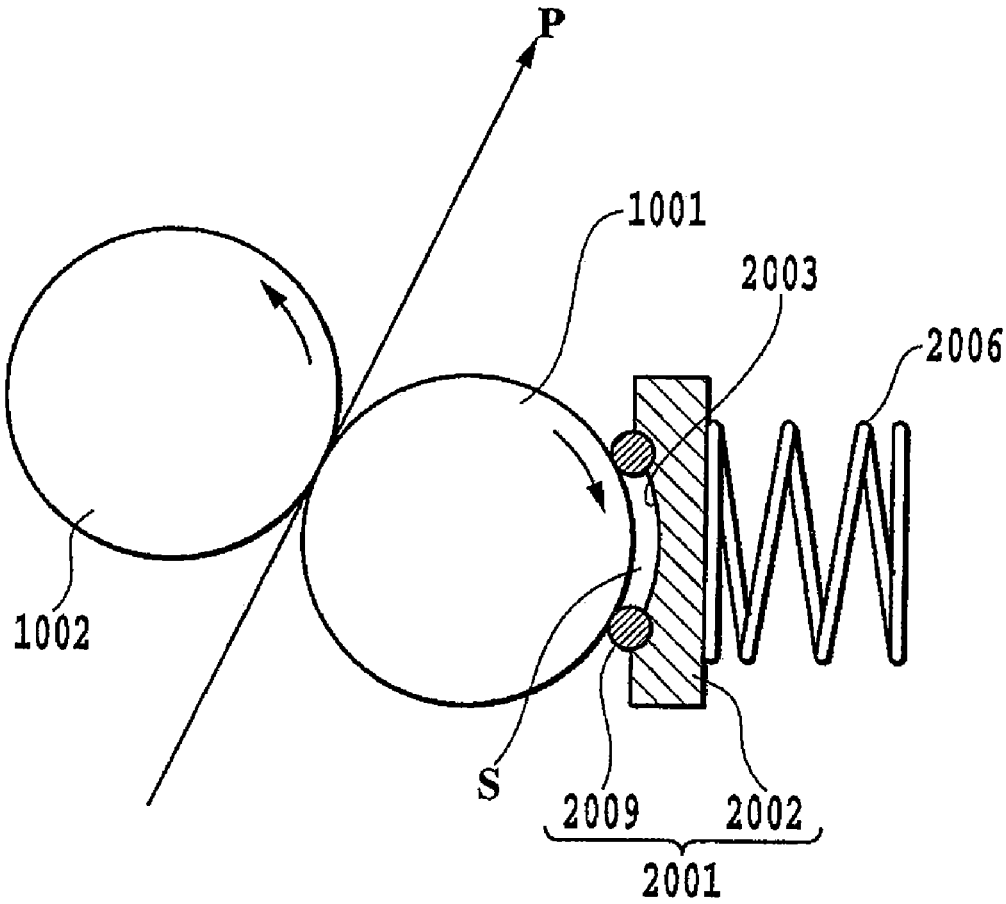
FIG. 2 is a longitudinal sectional side view showing an example of an arrangement of elements including an application roller, a counter roller and a liquid retention member.

FIG. 2 is an explanatory longitudinal sectional side view showing an example of an arrangement of elements including the application roller 1001, the counter roller 1002 and the liquid retention member 2001.

The counter roller 1002 is biased toward the circumferential surface of the application roller 1001 by bias means not shown, and rotates the application roller 1001 clockwise in the figure. This rotation makes it possible to hold, between both rollers, the application medium P to which the application liquid is applied, and to transfer the application medium P in the direction indicated by the arrow in the figure.

In this embodiment, silicone, of which the rubber hardness is 40 degrees, the surface roughness is Ra 1.6 μm, and the diameter is 23.169 mm is used as a material of the application roller 1001. An iron material, the diameter of which is 14 mm, is used as a material of the counter roller 1002.

The liquid retention member 2001 is designed to create an elongated liquid retention space S extending across a liquid application region of the application roller 1001 while the liquid retention member 2001 abuts on the circumferential surface of the application roller 1001, biased thereto by the bias force of a spring member (pressing means) 2006. The application liquid is supplied from the below-described liquid channel 3000 into the liquid retention space S through the liquid retention member 2001. In this case, since the liquid retention member 2001 is constructed as described below, it is possible to prevent the application liquid from accidentally leaking out of the liquid retention space S while the application roller 1001 is stopped.

A construction of the liquid retention member 2001 is shown in FIGS. 3 to 8.

Figure 3:
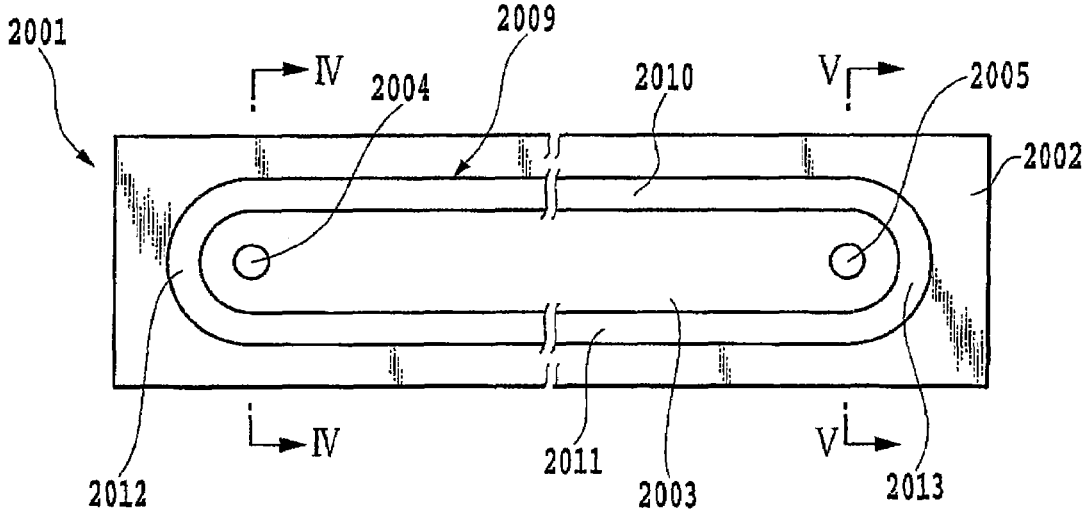
FIG. 3 is a front view of the liquid retention member shown in FIGS. 1 and 2.

As shown in FIG. 3, the liquid retention member 2001 includes a space creating base 2002 and an annular contact member 2009 provided on one surface of the space creating base 2002 in a protruding manner. In the space creating base 2002, a concave portion 2003, a bottom portion of which has a circular-arc cross section, is formed in the middle thereof along the longitudinal direction. Each straight portion of the contact member 2009 is fixedly attached to the space creating base 2002 along the edge portion of the concave portion 2003, and each circumferential portion thereof is fixedly attached to the space creating base 2002 so as to run from one edge portion to the other edge portion via the bottom portion. In this way, when abutting on the application roller 1001, the contact member 2009 of the liquid retention member 2001 can abut thereon in conformity with the shape of the circumferential surface of the application roller, which realizes the abutting with a uniform pressure.

As described above, with regard to the liquid retention member in this embodiment, the seamless contact member 2009 formed in one body is caused to abut on the outer circumferential surface of the application roller 1001 consecutively with no space therebetween by the bias force of the spring member 2006. As a result, the liquid retention space S becomes a substantially closed space defined by the contact member 2009, one surface of the space creating base and the outer circumferential surface of the application roller 1001, and the liquid is retained in this space. Thus, while the rotation of the application roller 1001 is stopped, the contact member 2009 and the outer circumferential surface of the application roller 1001 can keep a fluid-tight state, and can surely prevent the liquid from leaking out. On the other hand, when the application roller 1001 rotates, as described later, the application liquid can pass through the interface between the outer circumferential surface of the application roller 1001 and the contact member 2009 and adhere the outer circumferential surface of the application roller like layer. "While the application roller 1001 is stopped, the outer circumferential surface thereof and the contact member 2009 are in a fluid-tight state" means that, as described above, the liquid is not allowed to pass through the boundary between the inside and the outside of the space.

In this case, the abutting condition of the contact member 2009 includes a condition where the contact member 2009 abuts on the outer circumferential surface of the application roller 1001 with a film of the liquid, which is formed by the capillary action, interposed therebetween, as well as a condition where the contact member 2009 directly abuts on the outer circumferential surface of the application roller 1001.

Figure 4:
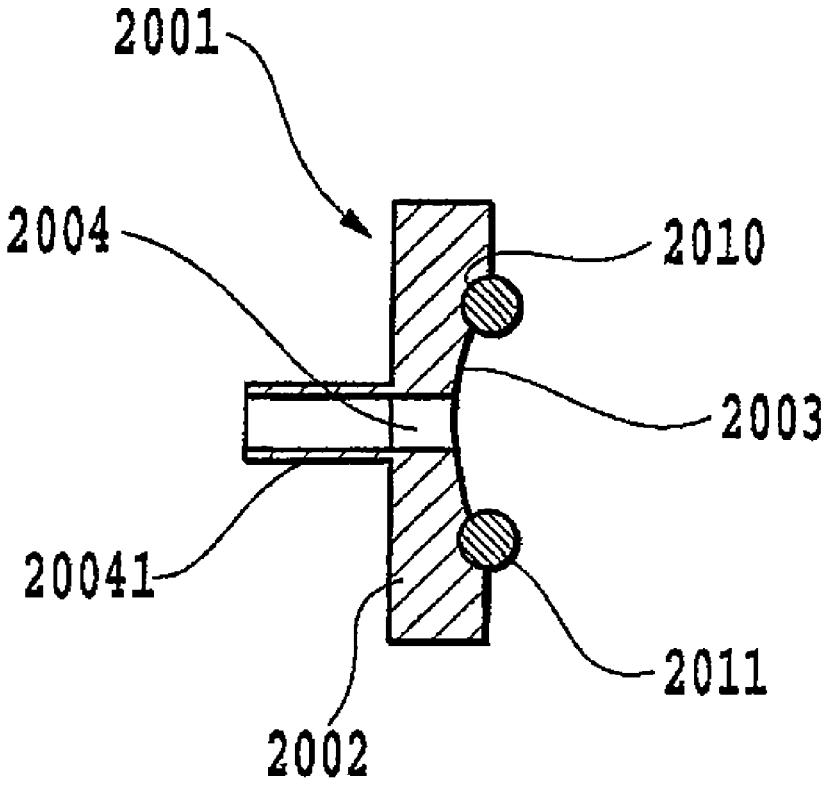
FIG. 4 is an end view showing an end obtained by cutting the liquid retention member shown in FIG. 3 along the line IV-IV.
Figure 5:
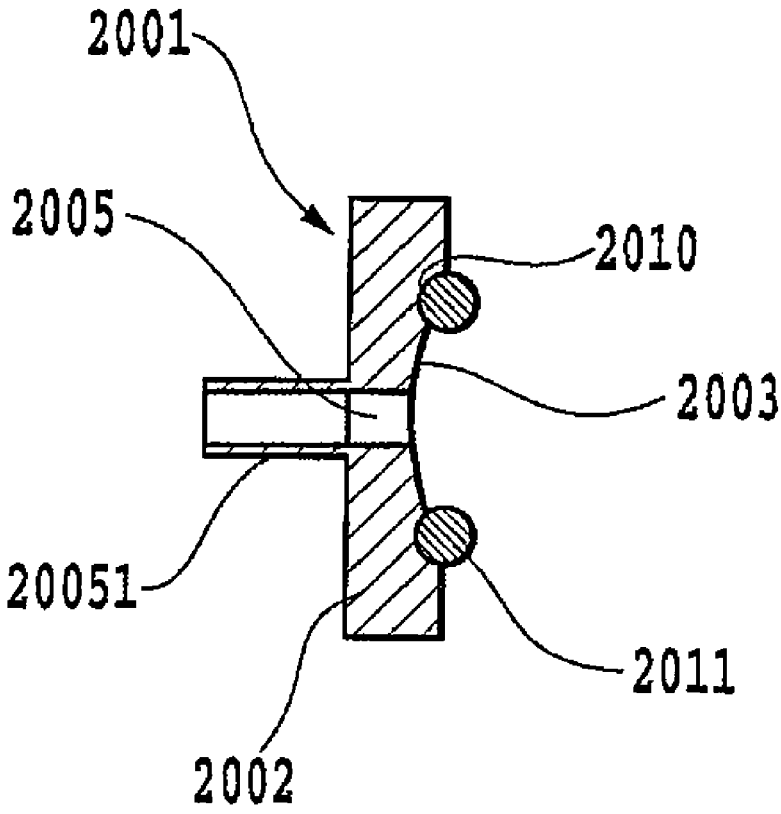
FIG. 5 is an end view showing an end obtained by cutting the liquid retention member shown in FIG. 3 along the line V-V.
Figure 6:
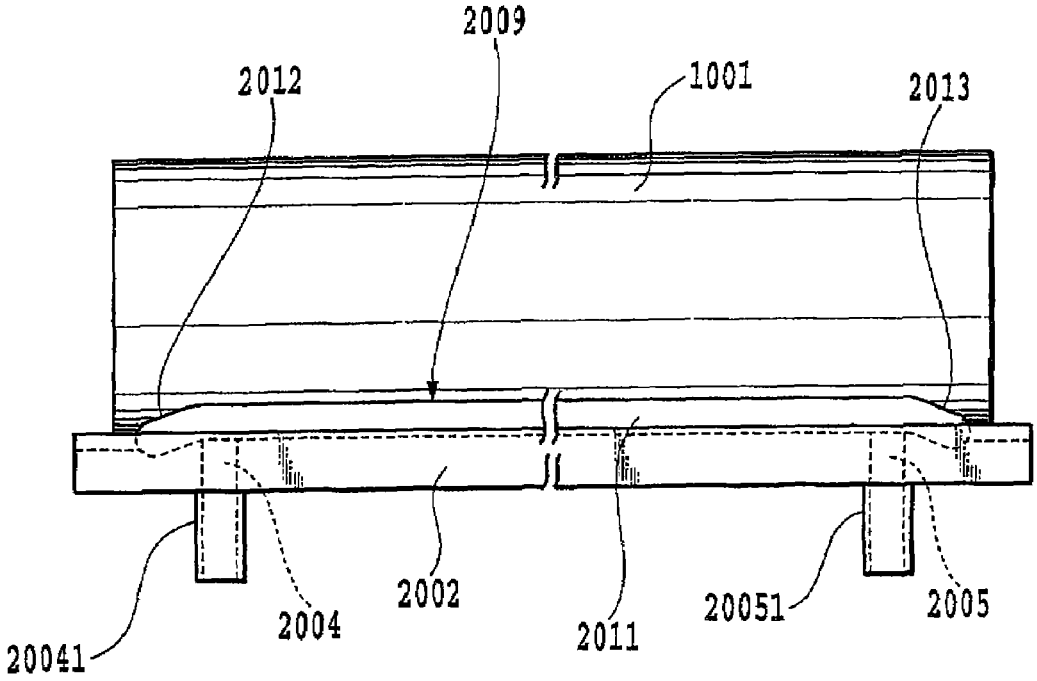
FIG. 6 is a plan view of the liquid retention member shown in FIG. 3.
Figure 7:
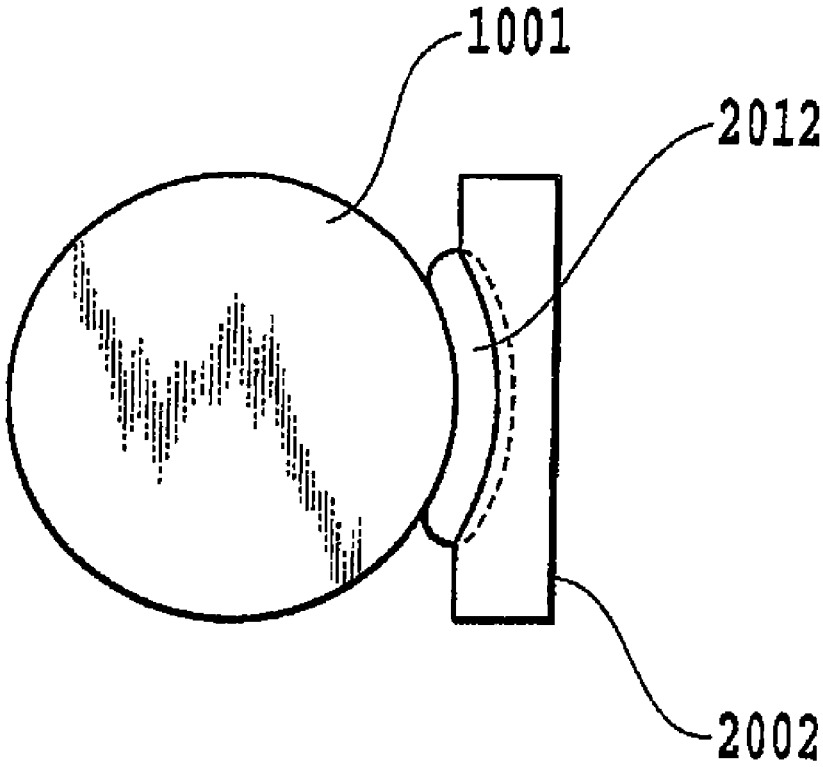
FIG. 7 is a left side view showing a state where a contact portion of the liquid retention member shown in FIG. 3 is allowed to abut on the liquid application roller.
Figure 8:
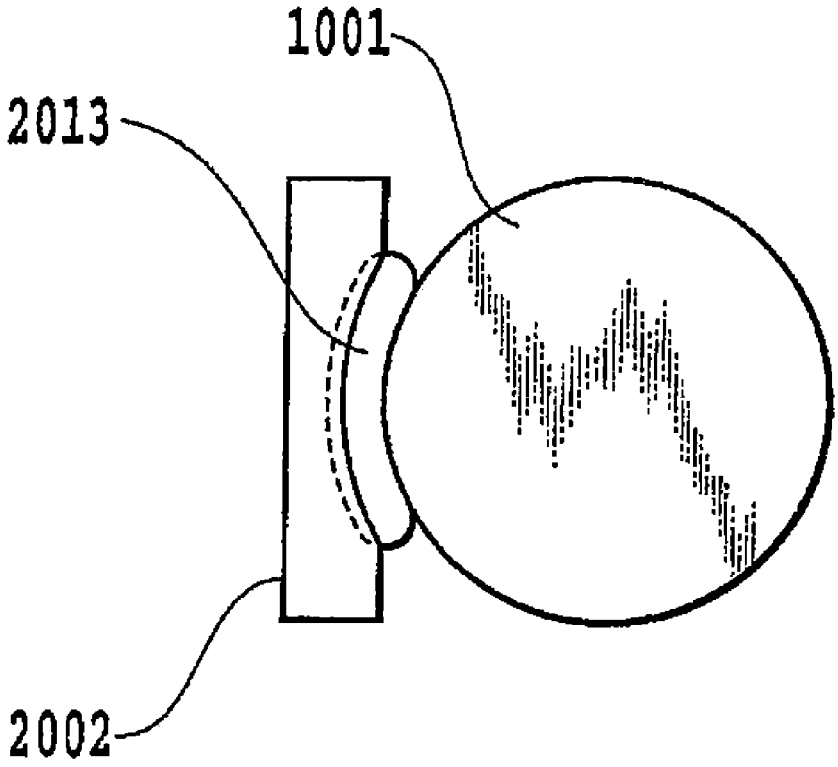
FIG. 8 is a right side view showing a state where the contact portion of the liquid retention member shown in FIG. 3 is allowed to abut on the liquid application roller.

The left and right end portions of the contact member 2009 in the longitudinal direction have a gently curved shape when viewed from any one of the front thereof (FIG. 3), the top thereof (FIG. 6), and a side thereof (FIGS. 7 and 8), as shown in FIGS. 3 to 8. As a result, even when the contact member 2009 is allowed to abut on the application roller 1001 with a relatively high pressure, the whole contact member 2009 is elastically deformed substantially uniformly, and local large deformation does not occur. Thus, the contact member 2009 abuts on the outer circumferential surface of the application roller 1001 consecutively with no space therebetween, and can create the substantially closed space, as shown in FIGS. 6 to 8.

On the other hand, as shown in FIGS. 3 to 5, the space creating base 2002 is provided with a liquid supply port 2004 and a liquid collection port 2005 in the region surrounded by the contact member 2009, each port being formed by making a hole penetrating the space creating base 2002. These ports communicate with cylindrical joint portions 20041 and 20051, respectively, which are provided on a back side of the space creating base in a protruding manner. The joint portions 20041 and 20051 are in turn connected to the below-described liquid channel 3000. In this embodiment, the liquid supply port 2004 is formed near one end portion (the left end portion in FIG. 3) of the region surrounded by the contact member 2009, and the liquid collection port 2005 is provided near the other end portion (the right end portion in FIG. 3) of the same region. The liquid supply port 2004 is used to supply, to the above-described liquid retention space S, the application liquid supplied from the liquid channel 3000. The liquid collection port 2005 is used to allow the liquid in the liquid retention space S to flow out to the liquid channel 3000. By supplying the liquid and allowing the liquid to flow out, the application liquid is caused to flow from the left end portion to the right end portion in the liquid retention space S.

(Application Liquid Channel)

Figure 11:
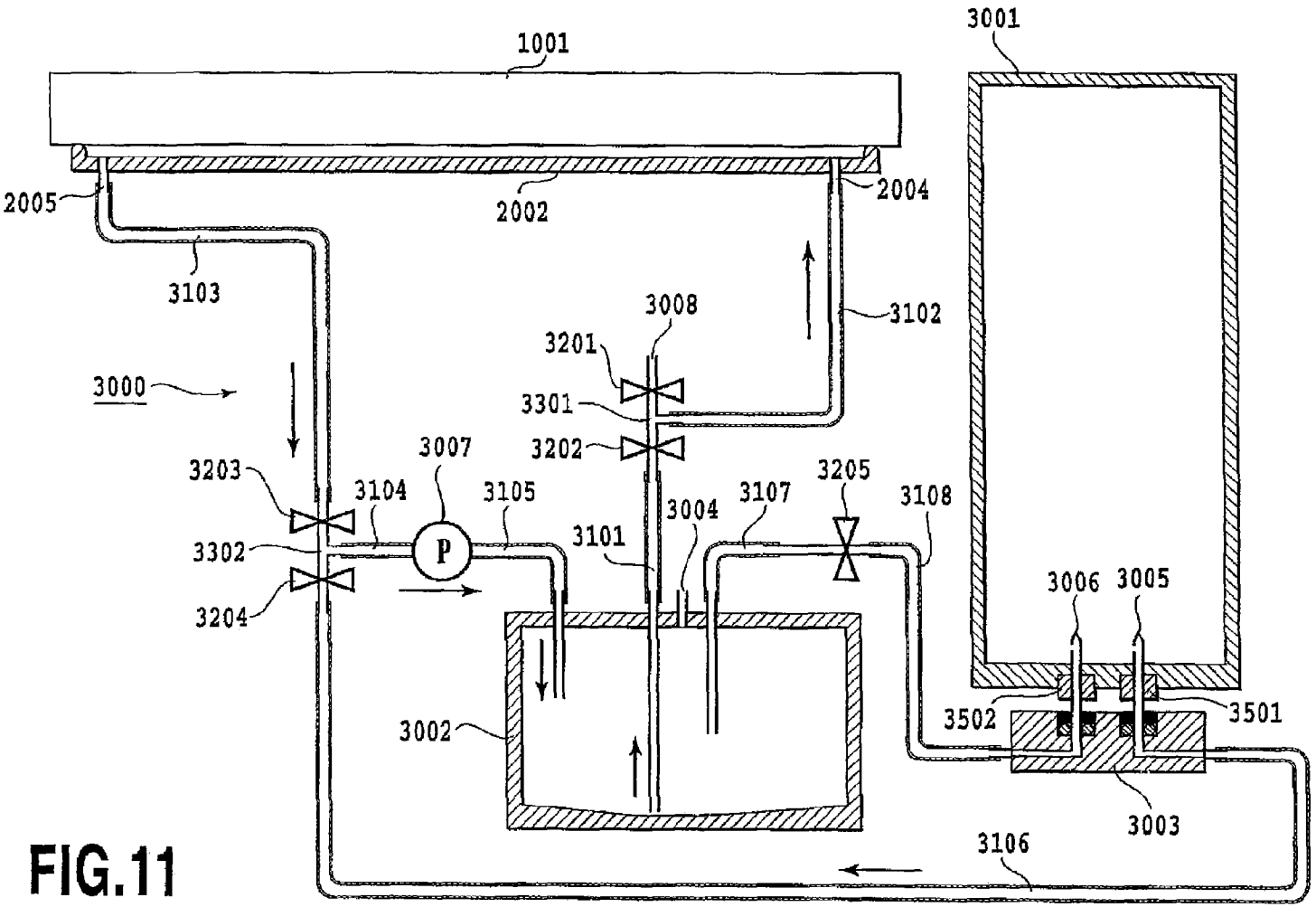
FIG. 11 is a perspective view showing a configuration of a liquid application device in the embodiment of the present invention.

FIG. 11 is an explanatory diagram showing a schematic configuration of the liquid channel 3000 linked with the liquid retention member 2001 of the aforementioned application liquid supply means.

This liquid channel 3000 includes a tube 3101 and a tube 3102 both included in a first channel (a supply channel), which links a liquid supply port 2004 of a space-creating base 2002 constituting the liquid retention member 2001, with a buffer tank 3002 storing the application liquid. In addition, the liquid channel 3000 includes a tube 3103, a tube 3104, and a tube 3105 all included in a second channel (a collection channel), which links the liquid collection port 2005 of the space-creating base 2002 with the buffer tank 3002 storing the application liquid. An atmosphere communication port 3004 is provided to this buffer tank 3002.

A first T-shaped channel 3301 linking three ports opening in three different directions is provided between the tubes 3101 and 3102 included in the first channel. The first T-shaped channel 3301 has a linking port 3008, which is one of the three ports, allowed to communicate with the atmosphere. A first shutoff valve 3201 is provided in a part of the first T-shaped channel from the confluence of the three ports toward the communication port 3008 allowed to communicate with an atmosphere. The first shutoff valve 3201 enables the communication port 3008 and the first T-shaped channel 3301 to switch between communication with, and shutoff from each other. Additionally, the first T-shaped channel 3301 is linked with the buffer tank 3002 by means of the tube 3101. A second shutoff valve 3202 is provided in a part of the first T-shaped channel from the confluence of the three ports toward a linking port allowed to communicate with the tube 3101. The second shutoff valve 3202 enables the tube 3101 and the first T-shaped channel 3301 to switch between communication with and shutoff from each other. Furthermore, the first T-shaped channel 3301 has the remaining linking port linked to the liquid supply port 2004 by means of the tube 3102. By using combinations of communication and shutoff of the first and the second shutoff valves 3201 and 3202, this construction formed of these two shutoff valves 3201 and 3202 and of the first T-shaped channel 3301 makes it possible to select between the atmosphere and the buffer tank 3002, the destination to which the tube 3102 is linked.

Furthermore, a pump 3007 for forcing the application liquid and air to flow in a direction toward the buffer tank 3002 inside the liquid channel 3000 is arranged in the second channel including the tubes 3103, 3104 and 3105. The tube 3104 is linked with one side of the pump 3007 through which the application liquid enters (also referred to as "the upstream side" in this specification). On the other hand, the tube 3105 is linked with the other side of the pump 3007 through which the application liquid flows out (also referred to as "the downstream side" in this specification). This tube 3105 links the buffer tank 3002 with the pump 3007. The tube 3104 links the pump 3007, and the second T-shaped channel 3302 which links the three ports. The tube 3103 links the second T-shaped channel 3302 with the liquid collection port 2005.

By driving the pump 3007 with the buffer tank 3002 and the space-creating base 2002 being linked via the first and the second channels, it becomes possible to supply the application liquid in the buffer tank 3002 to the space-creating base 2002 while the application liquid is circulated through the space-creating base 2002.

Furthermore, the liquid channel 3000 includes: a third channel (a refilling channel) linking an exchangeable exchange tank 3001, which stores the application liquid, with the second channel; and a fourth channel linking the buffer tank 3002 with the exchange tank 3001. Note that the exchange tank 3001 is a tank having a larger cubic capacity than the buffer tank 3002.

The tube 3106 included in the third channel is linked with the exchange tank 3001 via a first linking port 3005, shaped like an injection needle, and a pedestal 3003 which constitutes a linking channel. That is, the tube 3106 is linked with the exchange tank 3001 by causing the first linking port 3005, which is shaped like an injection needle, to penetrate rubber 3501 provided to the bottom of the exchange tank 3001. The other opening of the tube 3106 is linked with the second T-shaped channel 3302. In this embodiment, the tube 3106 becomes the refilling channel for supplying the application liquid from the exchange tank 3001 to the buffer tank 3002.

The aforementioned second T-shaped channel 3302 is provided with a third shutoff valve 3203 in a part of the second T-shaped channel from the confluence linking the three ports toward a linking port linked with tube 3103. The third shutoff valve 3203 enables the tube 3103 and the second T-shaped channel 3302 to switch between communication with and shutoff from each other. Additionally, the second T-shaped channel 3302 is provided with a fourth shutoff valve 3204 in a part of the second T-shaped channel from the confluence toward a linking port linked with the tube 3106. The fourth shutoff valve 3204 enables the tube 3106 and the second T-shaped channel 3302 to switch between communication with and shutoff from each other. By using combinations of communication and shutoff of the third and the fourth shutoff valves 3203 and 3204, this construction formed of these two shutoff valves 3203 and 3204 and of the second T-shaped channel 3301 makes it possible to select between the exchange tank 3001 and the space-creating base 2002, the destination to which the tube 3104 is linked.

The fourth channel includes a tube 3107 and a tube 3108. The tube 3108 included in the fourth channel is linked with the exchange tank 3001 via a second linking port 3006, shaped like an injection needle, and the pedestal 3003 constituting the linking channel. That is, the tube 3108 is linked with the exchange tank 3001 by causing the second linking port 3006, which is shaped like an injection needle, to penetrate rubber 3502 provided to the bottom of the exchange tank 3001. The exchange tank 3001 communicates with the buffer tank 3002 through a fifth shutoff valve 3205 which enables the tube 3107 and the tube 3108 to switch between communication with and shutoff from each other.

Note that provision of the fourth channel eliminates necessity of providing the exchange tank 3001 with an atmosphere communication port. Additionally, the provision of the fourth channel enables circulation refilling when the application liquid is refilled in the buffer tank 3002 from the exchange tank 3001. If the application liquid remains inside the buffer tank 3002 at the time of refilling the application liquid in the buffer tank 3002, this remaining liquid sometimes comes to have thickened due to vaporization thereof and the like. According to this embodiment, however, the application liquid supplied to the buffer tank 3002, and the remaining application liquid are mixed with each other. Moreover, application liquid obtained by the mixture is sent to the exchange tank 3001 by the circulation refilling. An influence on the application liquid from vaporization in the buffer tank can be further reduced.

In this embodiment, each of the linking ports to the exchange tank 3001 is shaped like an injection needle, and the bottom of the exchange tank 3001 is sealed with the rubber. Thereby, vaporization of the application liquid in the exchange tank 3001, which may occur while the exchange tank is not yet attached, can be suppressed.

Note that switching of each shutoff valve is performed by control signals from a later-described control unit 4000. By this signals, the filling, the supplying and the collecting of the application liquid are performed.

Additionally, the second T-shaped channel, and the third and the fourth shutoff valves may be arranged at any positions as long as the positions are between the pump 3007 and the liquid collection port 2005. In this embodiment, the tube 3103 is the collection channel for collecting the application liquid from the space-creating base 2002 (a liquid retention space S) into the buffer tank 3002, and the tube 3106 is the refilling channel. The second T-shaped channel, and the third and the fourth shutoff valves are configured to merge the tubes 3103 and 3106 with each other, and also, to perform switching the communication of the above collection channel with the tube 3104 and the communication of the above refilling channel with the tube 3104.

Moreover, the above second T-shaped channel, and third and fourth shutoff valves may be arranged, as described later, between the liquid supply port 2004 and the buffer tank 3002. That is, the second T-shaped channel, and the third and the fourth shutoff valves may be arranged at any positions as long as the positions are upstream of the pump 3007.

In this embodiment, in the upstream side of the pump 3007, links of a channel, which merges the collection channel and the refilling channel with each other, and leads to the pump 3007, with the collection channel and with the refilling channel are switched. When the collection channel and the pump 3007 are linked at the time of this switching, the refilling channel and the pump 3007 are not linked. Consequently, at this time, circulation of the application liquid can be performed through the first channel, the liquid retention space S, and the second channel by means of the pump 3007. And the application liquid can be supplied to and collected from the liquid retention space S respectively through the first and the second channels by means of the pump 3007. On the other hand, when the refilling channel and the pump 3007 are linked by this switching, the collection channel and the pump 3007 are not linked. Consequently, at this time, the application liquid can be refilled in the buffer tank 3002 from the exchange tank 3001 through the third channel.

Thus, in this embodiment, the collection channel and the refilling channel are merged with each other, and the links with these channels are switched, in the upstream side of the pump 3007. Thereby, out of the above two channels, one which does not communicate with the pump 3007 is blocked against the pump 3007. Consequently, it becomes possible to perform, only by means of one pump, control over the liquid channel including the buffer tank 3002 and the exchange tank 3001. That is, no additional pump is needed even though the buffer tank and the exchange tank are simultaneously arranged in a single device. Accordingly, there is no need of increasing channels and control units along with an increase of the pumps. Since an increase in the number of parts including a pump can be suppressed thereby, cost reduction thereof can be realized while upsizing of the device is not brought about.

A conventional type liquid application device including the application mechanism supplies application liquid to application liquid storage means included in the liquid application device, from storage means provided as a separate body from the liquid application device. The supply from the separate storage means to the application liquid storage means included in the liquid application device is controlled by a valve such as a faucet in this device. In a construction of this kind, however, the storage means is absolutely separate from the application liquid storage means, a construction of a liquid application system including the above storage means becomes upsized. Consequently, accommodating all of members of the system in a single, downsized device is desired.

In contrast to the above case, only a single pump is needed in this embodiment even when the buffer tank 3002 and the exchange tank 3001 are provided in the same one device as described above. Consequently, according to this embodiment, it becomes possible to accommodate, in a single liquid application device, members necessary for liquid application also in a case where the buffer tank is provided for the purpose of, for example, controlling a difference in water head.

Additionally, in this embodiment, avoiding waste clogging in the injection-needle like linking ports, which is otherwise caused by foreign particles, paper dust and the like having intruded during the application operation, is made possible by the circulation of the application liquid in the first channel, the liquid retention space S, the second channel and the buffer tank 3002 during an application operation.

Meanwhile, in order to apply the application liquid in a stable amount from the liquid retention space S to the application roller 1001, it is desirable, even when the application liquid in the storage tank is consumed, to suppress fluctuation in water head difference between the liquid surface of the application liquid in the storage tank, and that in the liquid retention space S. In order to suppress the fluctuation in the head pressure difference occurring with consumption of the application liquid in the storage rank, it is only necessary to reduce the height of the storage tank. However, a preferable storage tank is the one which is capable of storing larger amount of application liquid. From this point of view, the bottom face area of the storage tank, with a reduced height, should be larger when application liquid is to be stored in a large amount. This will make the device larger in size.

In response to this problem, the exchange tank 3001 and the buffer tank 3002, each of which has a different role, are used in this embodiment. That is, by using the buffer tank 3002 having a smaller cubic capacity than the exchange tank 3001, and arranged at a lower part than the exchange tank 3001 in the gravitational direction at least, circulation of the application liquid through, filling thereof in, and collection thereof from the liquid retention space S are performed. Additionally, a large amount of the application liquid is stored in a single device by using the exchange tank 3001 having a larger cubic capacity than the buffer tank 3002. Since the cubic capacity of the buffer tank 3002 is smaller than that of the exchange tank 3001, the application liquid in the buffer tank 3002 is used out in a shorter time than that in the exchange tank 3001. However, the application liquid is refilled in the buffer tank 3002 from the exchange tank 3001 whenever the application liquid in the buffer tank 3002 is used out. Accordingly, the height of the storage tank (buffer tank), which is involved in the filling of application liquid in, collection thereof from, and circulation through the liquid retention space S, can be reduced while the amount of the application liquid storable in the device is made large. Consequently, even when the application liquid in the buffer tank 3002 is consumed, fluctuation in the water head difference between the liquid surface of the application liquid in the buffer tank 3002, and that in the liquid retention space S can be suppressed. As a result, it becomes possible to stabilize the amount of the application liquid applied by means of the application roller 1001.

Additionally, by suppressing the fluctuation in the above water head difference, abrasion of the application roller 1001 and the contact member 2009 can be reduced. In this embodiment, the pump 3007 is provided to the collection side of the buffer tank 3002. Accordingly, at the time of the circulation of the application liquid, the pressure at the liquid collection port 2005 becomes low relatively to the pressure at the liquid supply port 2004. Thus, the circulation by a decompression method is achieved. Consequently, while a negative pressure is generated in the liquid retention space S, this negative pressure becomes larger as the above water head difference increases. In this embodiment, while the contact member 2009 is pressed against the application roller 1001 by a spring biasing force of the spring member 2006, the above pressing force increases as the negative pressure increases as a result of increase in the above water head difference. With this increase in the pressing force, abrasion in a contact portion between the application roller 1001 and the contact member 2009 increases.

Nevertheless, the above abrasion can be reduced in this embodiment, because the fluctuation in the above water head difference can be suppressed. As a result, it becomes possible to enhance durability of the application roller 1001 and the contact member 2009.

(Control System)

Figure 12:
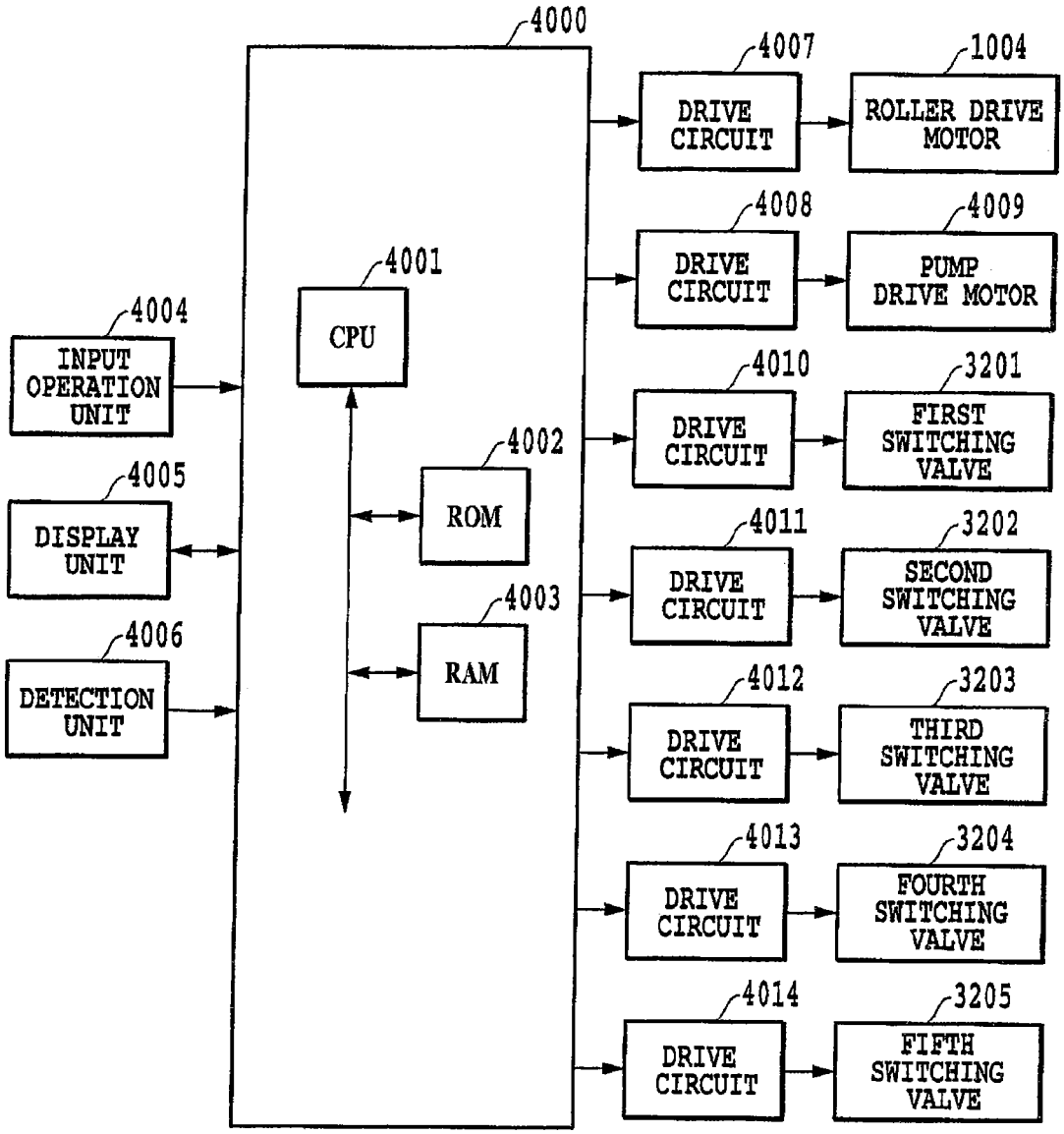
FIG. 12 is a block diagram showing a schematic configuration of a control system in the embodiment of the present invention.

FIG. 12 is a block diagram showing a schematic configuration of a control system in the liquid application device of this embodiment.

In this drawing, reference numeral 4000 denotes a control unit as control means which controls the whole liquid application device. This control unit 4000 includes a CPU 4001 which executes various processing such as computation, control and discrimination. The control unit 4000 further includes: a ROM 4002 which stores, for example, a control program executed by the CPU 4001 for processes and the like which will be described later in connection with FIG. 13; a RAM 4003 which temporarily stores input data and data which is being processed by the CPU 4001; and the like.

An input operation unit 4004 including a keyboard or various switches with which a predetermined command, data and the like are inputted, and a display unit 4005 displaying various information concerning, for example, input, settings, or the like of the liquid application device, are connected to this control unit 4000. In addition, a detection unit 4006 including a sensor, which detects the position of application medium, the operation condition of each portion, or the like, is connected to the control unit 4000. Moreover, the aforementioned roller drive motor 1004, a pump drive motor 4009, and the first to fifth switching valves are connected to the control unit 4000 via drive circuits 4007, 4008, 4010 to 4014, respectively.

(Liquid Application Operation Sequence)

Figure 13:
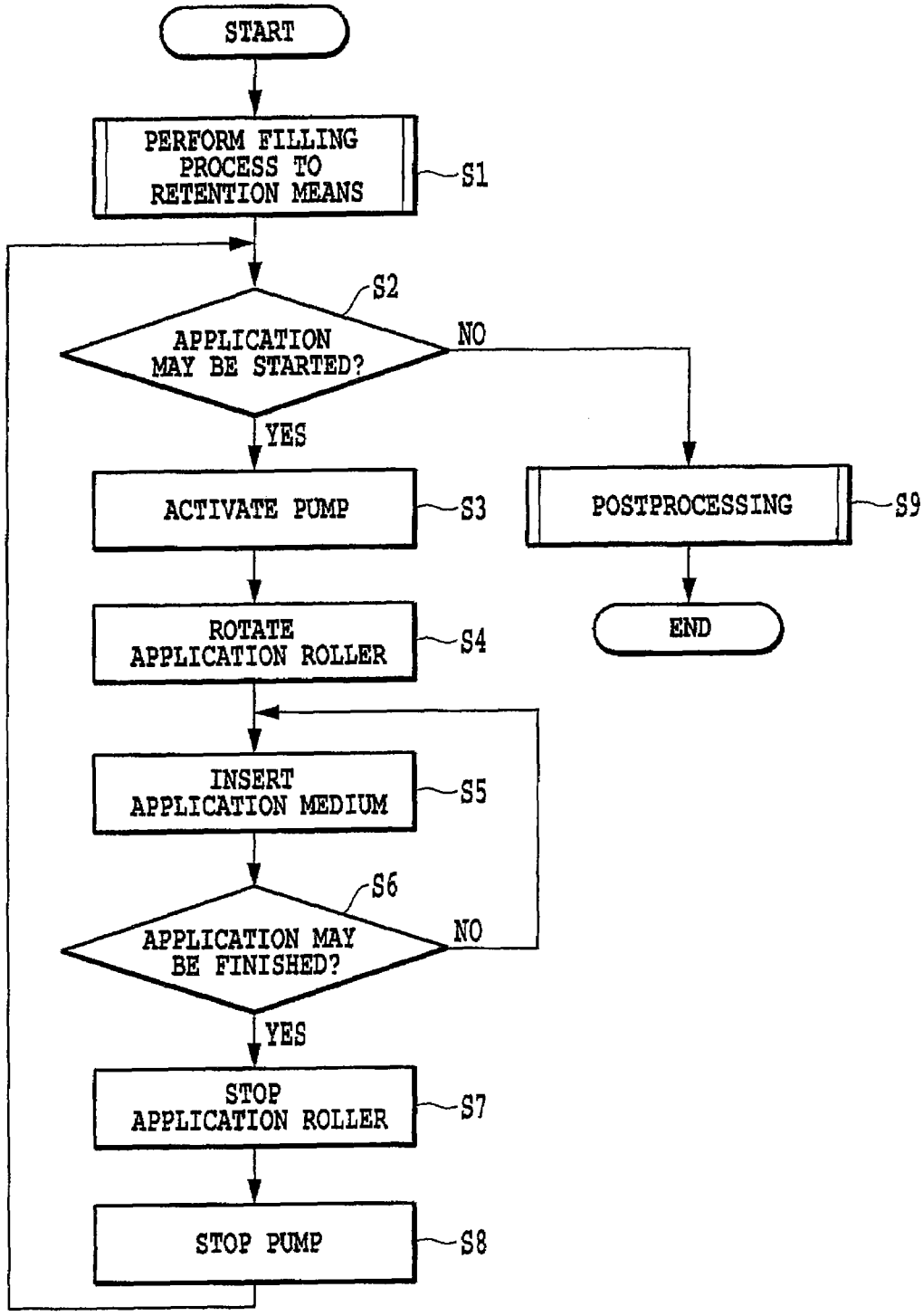
FIG. 13 is a flow chart showing a liquid-application operation sequence in the embodiment of the present invention.

FIG. 13 is a flow chart showing a procedure relating to the liquid application by the liquid application device of this embodiment. Hereinafter, steps relating to the liquid application will be described by referring to this flow chart. That is, when power is supplied to the liquid application device, the control unit 4000 executes the following application operation sequence as is shown in the flow chart shown in FIG. 13.

Note that open and close combinations of the shutoff valves are set to be four combinations for "letting stand", "refilling", "circulation" and "collection" shown in Table 1. The control unit 4000 selects, among the four, an adequate combination for the state of the device, and transmits a control signal to each shutoff valve so that each of the shutoff valves may perform an operation corresponding to the selected combination.

TABLE 1

| | First Shutoff Valve | Second Shutoff Valve | Third Shutoff Valve | Fourth Shutoff Valve | Fifth Shutoff Valve |
|---|---|---|---|---|---|
| Letting stand | Open | Close | Close | Close | Close |
| Refilling | Close | Close | Close | Open | Open |
| Circulation | Close | Open | Open | Close | Close |
| Collection | Open | Close | Open | Close | Close |

Note that the "letting stand" indicates states of the shutoff valves in the non-operating state where the application liquid has been collected. The "refilling" indicates states of the shutoff valves while the application liquid is being refilled from the exchange tank in the buffer tank. The "circulation" indicates states of the shutoff valves while the application liquid is being circulated in the first channel, the liquid retention space S and the second channel. The "collection" indicates states of the shutoff valves while the application liquid is being collected from the liquid retention space S into the buffer tank.

Filling Step:

In FIG. 13, a step of filling the application liquid in the above application retention space S is carried out in step S1. In this filling step, first of all, the pump 3007 is driven for a certain period of time with the shutoff valves being set to the open-close combination for the "circulation". This open-close combination allows the buffer tank 3002 to communicate with the liquid application space S via the first and the second channels. As a result, in a case where the application liquid has not been filled in the liquid application space S and the first and the second channels, the application liquid is filled in each of these portions while air inside of these portions is sent to the buffer tank 3002 to be exhausted to the atmosphere through the atmosphere communication port 3004. On the other hand, in a case where the application liquid has already been filled in these portions, the application liquid in each of the portions is caused to flow. As a result, the application liquid with adequate concentration and viscosity is supplied. This initial operation causes the device to go into a state where the application liquid has been supplied to the application roller 1001, thereby making application of the application liquid possible.

Refilling Step:

If it is judged in step S1, for example, by means of a sensor as liquid-surface management means for detecting the height of the liquid surface inside the liquid retention member, that the application liquid inside the buffer tank 3002 is not sufficiently filled, the shutoff valves are set to form the open-close combination for the "refilling." At the same time, the pump 3007 is driven for a certain period of time. With this open-close combination, the buffer tank 3002 is allowed to communicate with the exchange tank 3001 via the third and the fourth channels. In this way, filling of the application liquid in the buffer tank 3002 is progressed.

Figure 14:
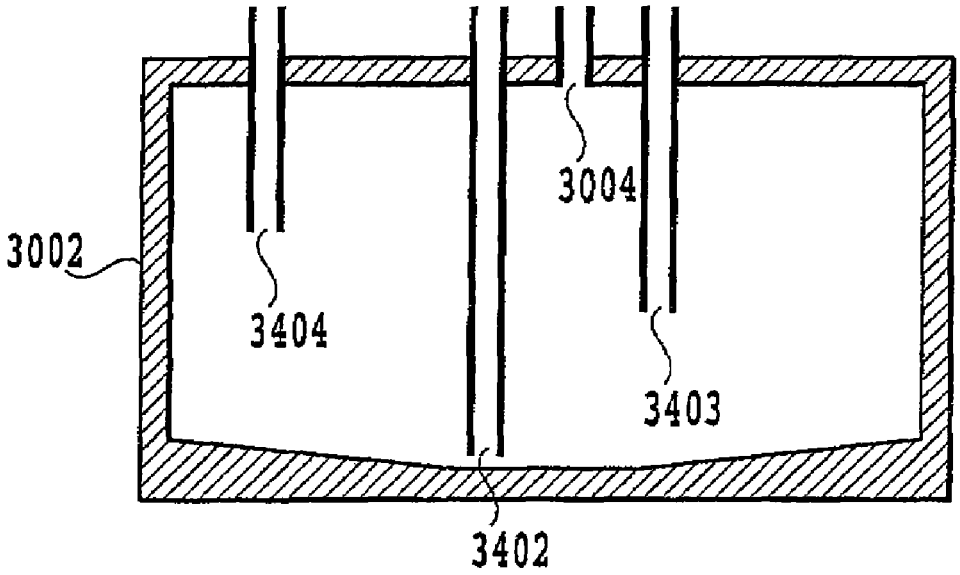
FIG. 14 is an illustration showing a buffer tank in the embodiment of the present invention.
Figure 15:
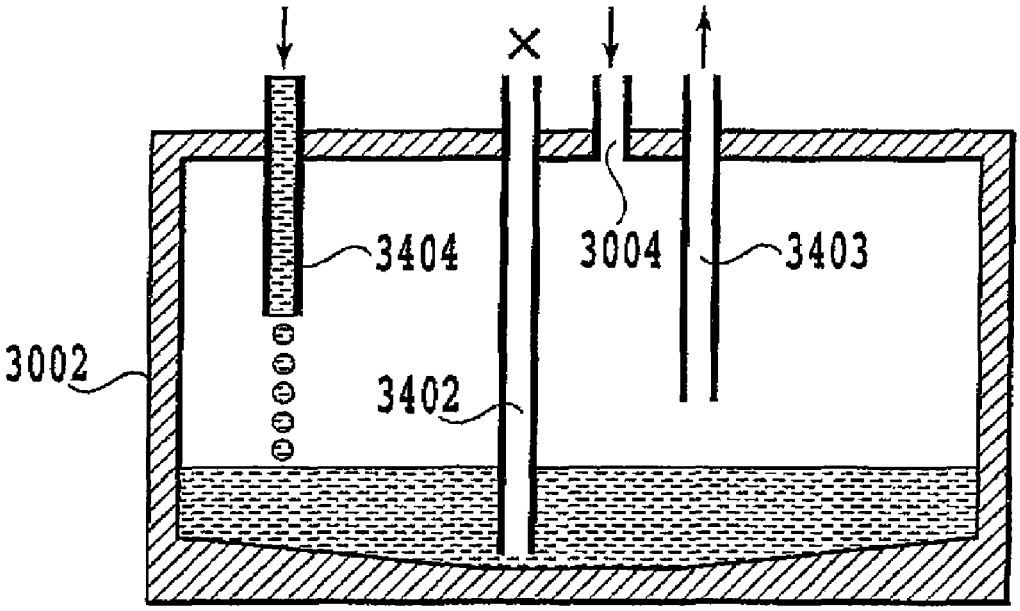
FIG. 15 is an illustration showing a situation where the application liquid is refilled in the buffer tank in the embodiment of the present invention.

A description will be given below of a situation, for example, where the application liquid is refilled in the buffer tank 3002 not filled with the application liquid, as shown in FIG. 14.

Figure 16:
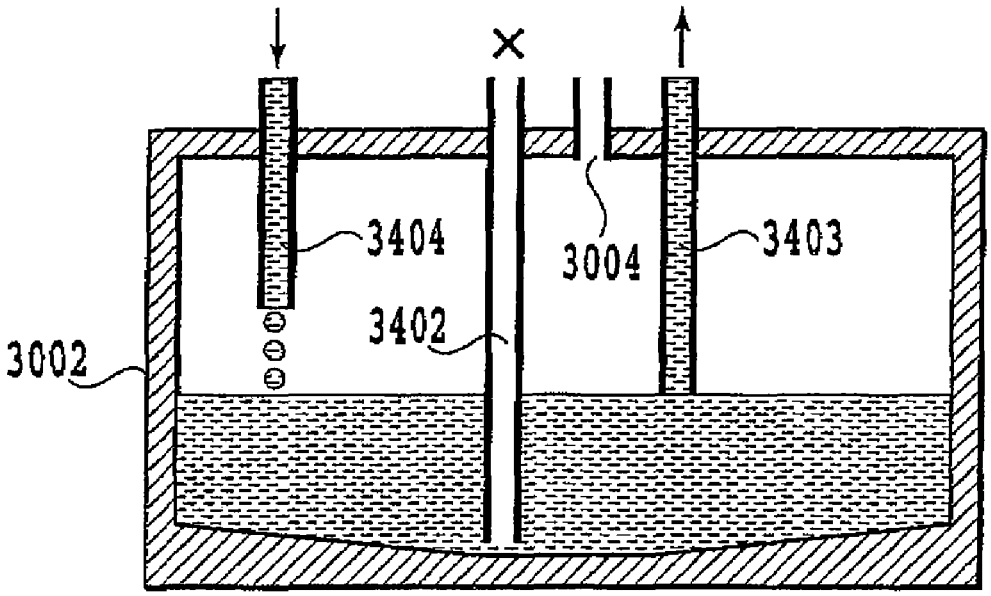
FIG. 16 is an illustration showing a situation where the application liquid is refilled in the buffer tank in the embodiment of the present invention.

In this embodiment, when the refilling step is started, i.e., when the shutoff valves form the combination for the "refilling," the application liquid is filled in the buffer tank 3002. That is, the application liquid, flowing therein from the exchange tank 3001 via the third channel, is filled in the buffer tank 3002 from an end portion 3404 of the third channel. The end portion 3404 is positioned inside the buffer tank 3002. At the same time, air flows into the buffer tank 3002 from the atmosphere communication port 3004, and is sent from an end portion 3403 of the fourth channel into the exchange tank 3001 via the fourth channel. The end portion 3403 is positioned inside the buffer tank 3002. In this manner, filling of the application liquid from the exchange tank 3001 in the buffer tank 3002 is progressed. As shown in FIG. 16, this filling is performed until the application liquid reaches the level corresponding to the end portion 3403 of the fourth channel. Once the application liquid is filled to the level corresponding to the end portion 3403 of the fourth channel, flow of the application liquid becomes circulating flow between the exchange tank 3001 and the buffer tank 3002, and the liquid surface level inside the buffer tank 3002 does not change. The application liquid never flows out from the atmosphere communication port if the end portion 3403 of the fourth channel is arranged at a lower position than the atmosphere communication port 3004 of the buffer tank 3002 in the gravitational direction. That is, without providing the sensor as means for detecting the liquid surface level inside the buffer tank 3002, management of the liquid surface becomes possible by use of the end portion 3403 of the fourth channel arranged at the above-described position.

Note that the second and the fifth shutoff valves are closed during the collection operation in this embodiment. Consequently, the surface level of the application liquid which is to be collected, and which exists in the liquid retention space S and the first and the second channels may reach a higher level than the end portion 3403 of the fourth channel depending on the storage status of the application liquid inside the buffer tank 3002 at the time of the collection. In consideration of this, the height of the end portion 3403 of the fourth channel is set in order that, even when the surface level of the application liquid inside the buffer tank 3002 reaches the level corresponding to the end portion 3403 of the fourth channel, the collected application liquid may end up being included in the space above the end portion 3403 of the fourth channel.

According to this construction, liquid leakage from the buffer tank 3002 does not occur regardless of the time period when the pump 3007 is driven in the refilling. This construction is effective also in a case where a system for refilling the liquid to a desirable level by driving the pump 3007 is adopted by providing in the buffer tank 3002 a sensor which detects the liquid surface level. With the construction of this embodiment, a possible liquid leakage from the buffer tank 3002 can be prevented even when the sensor detecting the above liquid surface level has broken down.

In a case where the end portion 3403 of the fourth channel is provided so as to control the liquid surface level inside the buffer tank 3002, it is preferable that the end portion 3403 of the fourth channel be provided in a higher part than an end portion 3402 of the first channel in the gravitational direction. This is because the liquid surface level inside the buffer tank 3002 cannot reach a higher part than the end portion 3403 of the fourth channel in the gravitational direction.

Additionally, in this embodiment, the end portion 3402 of the first channel inside the buffer tank 3002 is positioned in the vicinity of the bottom of the buffer tank 3002. By having the end portion 3402 thus positioned, intrusion of air bubbles into the first channel can be suppressed. In this manner, the buffer tank 3002 has not only functions of management of the water head difference, storage of the liquid, and management of the liquid surface level inside the tank, but also a function of deaeration.

Application Steps:

At this time, once an application start command is inputted (step S2), the application roller 1001 starts to rotate clockwise (step S4) as indicated by the arrow in FIG. 1 while the pump 3007 re-starts to operate (step S3). With this rotation of the application roller 1001, the application liquid L having been filled in the liquid retention space S overcomes the pressing force of the contact member 2009 of the liquid retention member 2001 against the application roller 1001. The application liquid L passes through an interface between the application roller 1001 and a lower edge portion 2011 of the contact member 2009. This application liquid L having passed through the interface adheres to the outer circumferential surface of the application roller 1001 forming a layer. The application liquid L having adhered to the application roller 1001 is sent to the contact portion between the application roller 1001 and the counter roller 1002.

Figure 9:
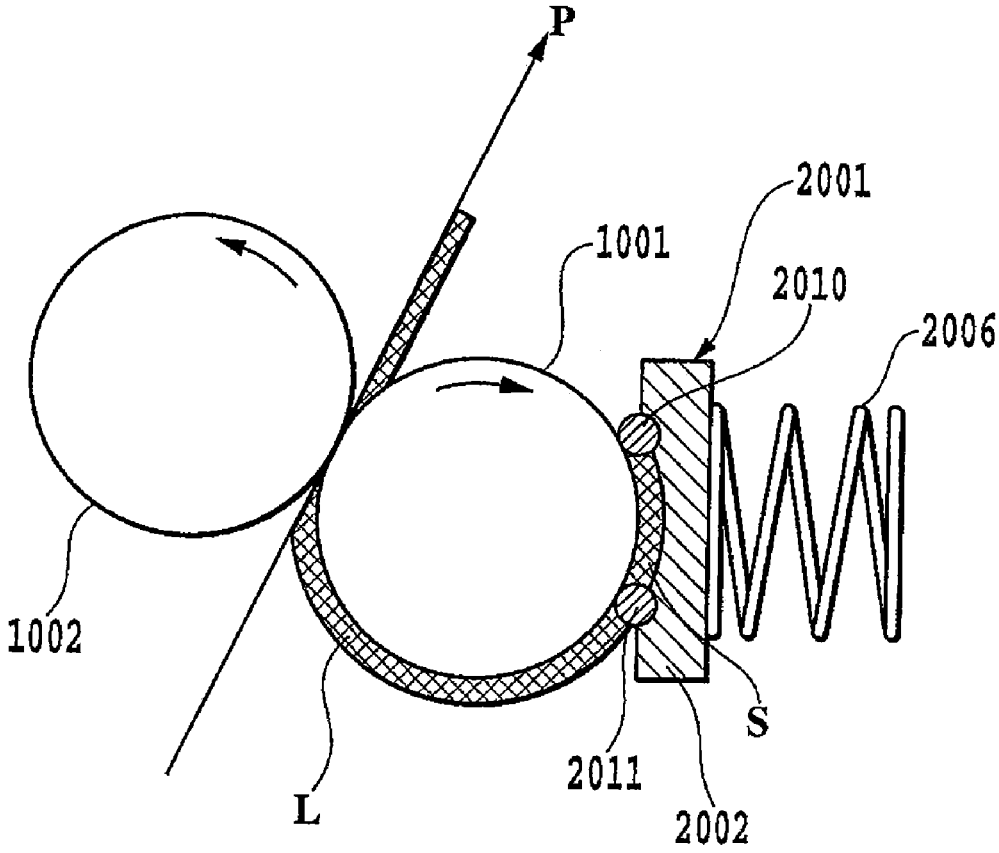
FIG. 9 is a longitudinal sectional view showing a state where a liquid retention space created by the liquid retention member and the application roller is filled with an application liquid, and the liquid is applied to an application medium as the application roller rotates in the embodiment of the present invention.

Subsequently, the application medium feeding mechanism 1006 transfers an application medium to the interface between the application roller 1001 and the counter roller 1002. The application medium is inserted between these rollers. Then, the inserted application medium is transferred toward the delivery unit as the application roller 1001 and the counter roller 1002 rotate (step S5). During this transfer, the application liquid applied to the outer circumferential surface of the application roller is transferred from the application roller 1001 to the application medium P as shown in FIG. 9. Needless to say, the means for feeding the application medium to the interface between the application roller 1001 and the counter roller 1002 is not limited to the above-mentioned feeding mechanism. Any means can be used. For example, manual feeding means accessorily utilizing a predetermined guide member may be additionally used, or the manual feeding means may be used singly.

In FIG. 9, the cross hatched part indicates the application liquid L. It should be note that, in this figure, the thicknesses of the layers of the application liquid on the application roller 1001 and the application medium P is depicted relatively larger than the actual thickness, for the purpose of the clear illustration of the state of the application liquid L shown at the time of the application.

In this way, the part of an application medium P to which the liquid has been applied is transferred in the direction indicated by the arrow by the transferring force of the application roller 1001, and, at the same time, the part of the application medium P to which the liquid is not applied is transferred to the contact area between the application medium P and the application roller 1001. By performing this operation continuously or intermittently, the application liquid is applied to the entire surface of the application medium.

Incidentally, FIG. 9 shows an ideal state of application where all the application liquid L, which has passed the contact member 2009 and has stuck to the application roller 1001, has been transferred to the application medium P. In fact, however, all the application liquid L having stuck to the application roller 1001 is not always transferred to the application medium P. Specifically, in many cases, when the transferred application medium P moves away from the application roller 1001, the application liquid L also sticks to the application roller 1001, and thus remains on the application roller 1001. The remaining amount of the application liquid L on the application roller 1001 varies depending on the material of the application medium P and the microscopic irregularities of the surface. In a case where the application medium is a plain paper, the application liquid L remains on the circumferential surface of the application roller 1001 after the application operation.

Figure 17:
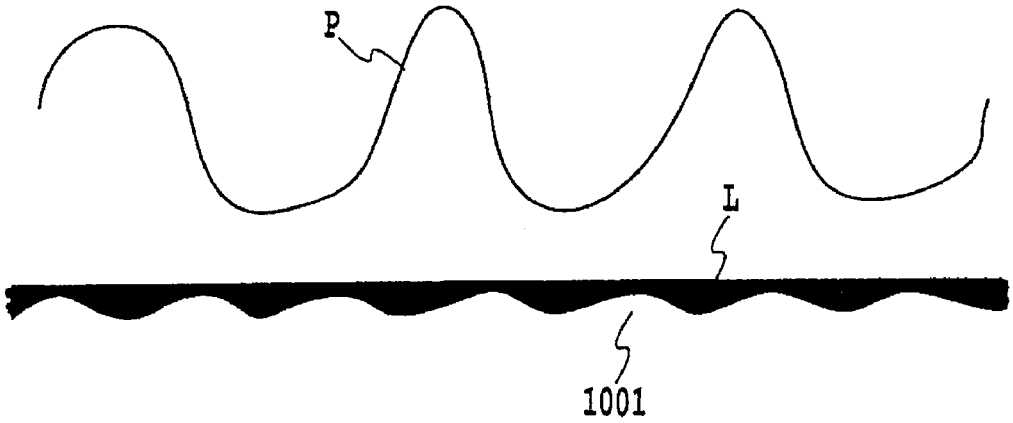
Figure 18:
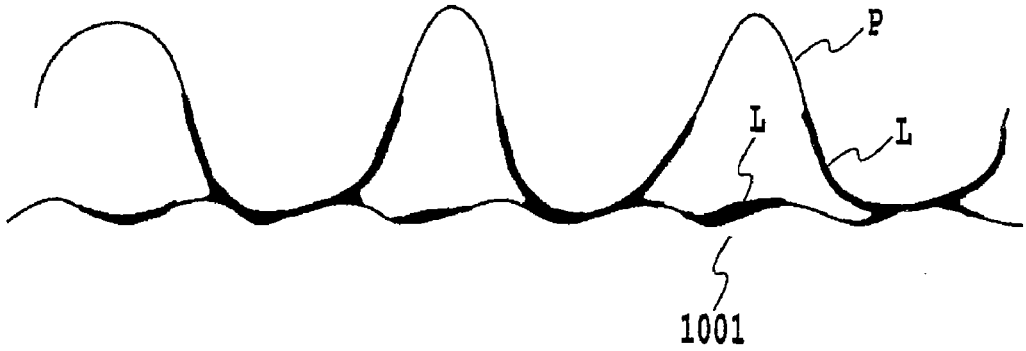
Figure 19:
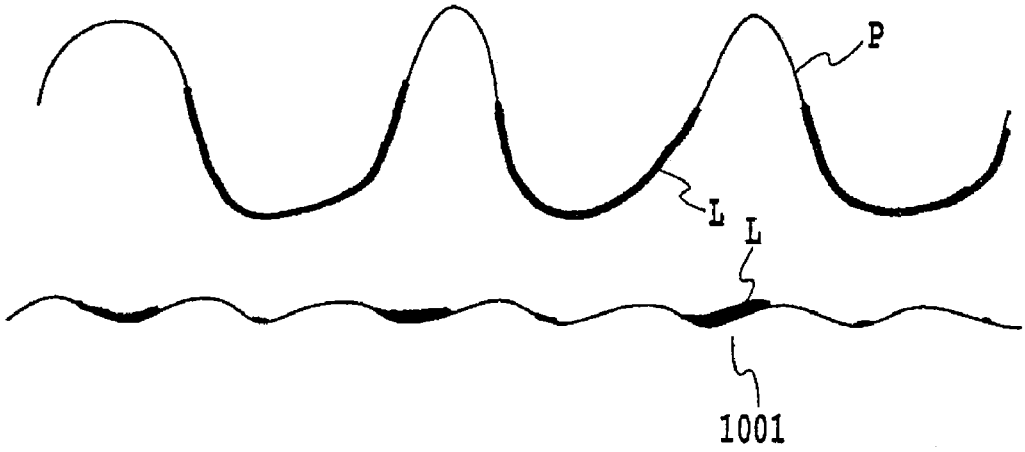

FIGS. 17 to 19 are explanatory diagrams for explaining an application process proceeding between the application surface and the surface of the medium in a case where the medium P is a plain paper. In these figures, the liquid is expressed by the regions filled in with black.

FIG. 17 shows a state of the application roller 1001 and the counter roller 1002 in an area upstream of the nip area thereof. In this figure, the liquid has stuck to the application surface of the application roller 1001 in such a manner that the liquid thinly covers the microscopic irregularities of the application surface.

FIG. 18 shows a state of both of the surface of the plain paper, which is the medium P, and the application surface of the application roller 1001 in the nip area of the application roller 1001 and the counter roller 1002. In this figure, the convex portions of the surface of the plain paper, which is the medium P, abuts on the application surface of the application roller 1001, and, from the abutting portions, the liquid instantly permeates into or sticks on the surface fibers of the plain paper, which is the medium P. The liquid which has stuck to the part of the application surface of the application roller 1001, which part does not abut on the convex portions of the surface of the plain paper, remains on the application surface of the application roller 1001.

FIG. 19 shows a state of the application roller 1001 and the counter roller 1002 in an area downstream of the nip area thereof. This figure shows a state where the medium and the application surface of the application roller 1001 have been completely separated from each other. The liquid sticking to those parts of the applying surface of the application roller 1001 which do not contact with the convex portions on the surface of the plain paper remains on the applying surface. The liquid on the contacting parts also remains with very small amount on the application surface.

The application liquid remaining on the application roller 1001 overcomes the pressing force of the contact member 2009 of the liquid retention member 2001 against the application roller 1001, passes through the interface between the application roller 1001 and an upper edge portion 2010 of the contact member 2009, and is brought back into the liquid retention space S. The returned application liquid is mixed with the application liquid filled in the liquid retention space S.

Figure 10:
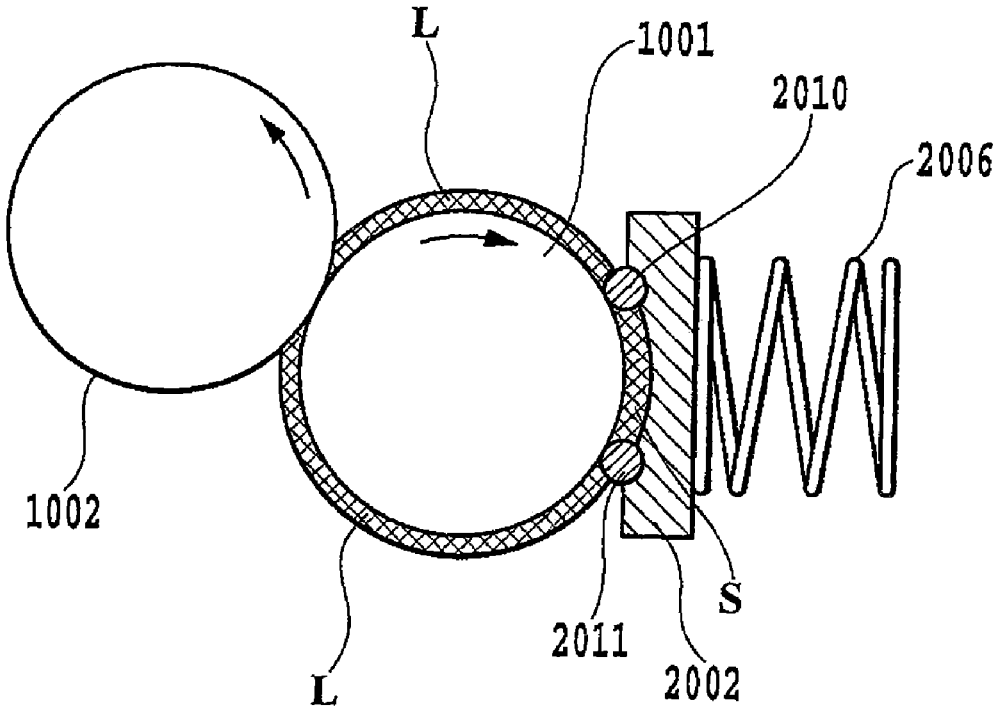
FIG. 10 is a longitudinal sectional view showing a state where the liquid retention space created by the liquid retention member and the application roller is filled with the application liquid, and the application roller is rotated with no application medium present in the embodiment of the present invention.

As shown in FIG. 10, also in a case where the application roller 1001 is rotated when there is no application medium, the returning operation of the application liquid is similarly performed. Specifically, the application liquid stuck to the circumferential surface of the application roller 1001 by rotating the application roller 1001 passes through the interface of the contact area between the application roller 1001 and the counter roller 1002. After this, the application liquid is distributed between the application roller 1001 and the counter roller 1002, and remains on the application roller 1001. The application liquid L sticking to the application roller 1001 passes through the interface between the upper edge portion 2010 of the contact member 2009 and the application roller 1001, enters the liquid retention space S, and is mixed with the application liquid filled in the liquid retention space S.

Finishing Steps:

Once the application operation onto the application medium is carried out in the above described manner, a judgment as to whether or not the application steps may be finished is subsequently made (step S6). If the application steps may not be finished, the sequence returns to step S5, and the application operation is repeated until the application steps are totally finished on all of parts of the application medium that require application of the application liquid on them. Once the application steps are totally finished, the application roller 1001 is stopped (step S7), and furthermore, drive of the pump 3007 is stopped (step S8). Thereafter, the sequence goes on to step S2, where, if the application start command is received, the operation corresponding to the aforementioned steps S2 to S8 is repeated. On the other hand, if the application start command is not received, postprocessing, such as the collection operation for collecting the application liquid in the liquid retention space S and the liquid channel, is performed (step S9), and thus processes involved in the application are ended.

Note that the above collection operation is performed by driving the pump 3007 for a certain period of time with the shutoff valves forming the open-close combination for the "collection." This open-close combination allows the buffer tank 3002 to communicate with the liquid application space S via the second channel. This combination also allows the first channel to communicate with the communication port 3008 which is an atmosphere communication port, thus allowing the liquid application space S to communicate with the communication port 3008. Thereby, the air is supplied to the tube 3102, the liquid application space S, the tubes 3103 and 3104, the pump 3007 and the tube 3105. The application liquid having been filled therein is collected into the buffer tank 3002. By performing this collection operation, it becomes possible to totally prevent, or at least reduce, vaporization of the application liquid from the liquid retention space S.

Additionally, after the collection operation, the shutoff valves are set to form the combination for the "letting stand." With this combination, the exchange tank 3001, the buffer tank 3002 and the liquid application space S come to be separated from one another. Consequently, even when the device tilts during transfer or carrying thereof, the application liquid can be prevented from flowing out or flowing out the application liquid can be reduced.

Note that, although the refilling of the application liquid from the exchange tank 3001 in the buffer tank 3002 is performed separately from the circulation of the application liquid through the liquid retention space S in this embodiment, the refilling and the circulation may be performed at the same time. In this case, it is only necessary to close the first shutoff valve 3201 and open the second to the fifth shutoff valves 3202 to 3205.

Second Embodiment

Next, a main part of a second embodiment of the present invention will be described based on the drawings.

Figure 24:
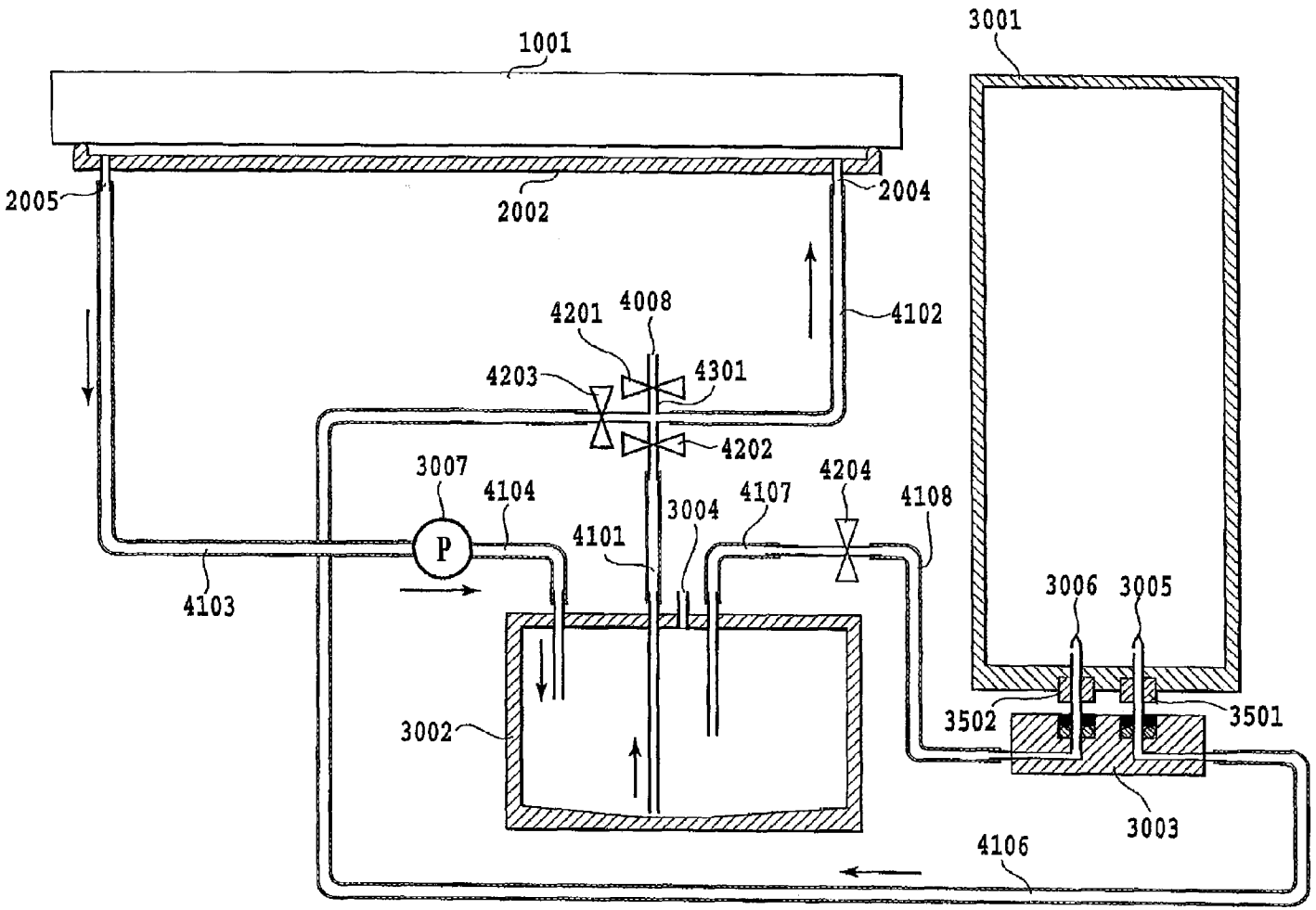
FIG. 24 is a perspective view showing a configuration of a liquid application device in another embodiment of the present invention.

FIG. 24 is an explanatory diagram showing a schematic construction of the liquid channel 3000, which is linked with the liquid retention member 2001 of the application liquid supply means, in the second embodiment.

In this embodiment, the same constructions as in the case with the first embodiment are employed for the application liquid supply means and the buffer tank. In this embodiment, in the circulation by the decompression method, merge of the first refilling channel from the exchange tank with the second refilling channel from the buffer tank, and switch between links with the first refilling channel and with the second refilling channel, are performed in a section between the buffer tank and the liquid supply port.

This liquid channel 3000 includes a channel 4101 and a channel 4102 both included in the first channel (supply channel) which links the buffer tank 3002 storing the application liquid, and the liquid supply port 2004 of the space-creating base 2002 constituting the liquid retention member 2001. In addition, the liquid channel 3000 includes a channel 4103 and a channel 4104 both included in the second channel (collection channel), which links the above buffer tank 3002, and the liquid collection port 2005 of the space-creating base 2002.

A cross-shaped channel 4301, which has four ports being linked together, is provided to the tubes 4101 and 4102 included in the first channel. A linking port 4008 among the four ports of the cross-shaped channel 4301 is allowed to communicate with the atmosphere. A first shutoff valve 4201 is provided in a part of the cross-shaped channel 4301 from a confluence linking the four ports toward the communication port 4008. The first shutoff valve 4201 enables the communication port 4008 and the cross-shaped channel 4301 to switch between communication with and shutoff from each other. Additionally, the cross-shaped channel 4301 is linked with the buffer tank 3002 via the tube 4101. In this embodiment, the tube 4101 becomes a second refilling channel. A second shutoff valve 4202 is provided in a part of the cross-shaped channel 4301 from the confluence linking the four ports toward a linking port linked with the tube 4101. The second shutoff valve 4202 enables the tube 4101 and the cross-shaped channel 4301 to switch between communication with and shutoff from each other. Furthermore, another linking port among the four ports of the cross-shaped channel 4301 is linked with the exchangeable exchange tank 3001, which stores the application liquid, via a tube 4106 included in a third channel. A third shutoff valve 4203 is provided in a part of the cross-shaped channel 4301 from the confluence linking the four ports toward the linking port linked with the tube 4106. The third shutoff valve 4203 enables the tube 4106 and the cross-shaped channel 4301 to switch between communication with and shutoff from each other. Moreover, the last linking port among the four ports of the cross-shaped channel 4301 is linked with the liquid supply port 2004 via the tube 4102. By using combinations of communication and shutoff of the three shutoff valves, a constitution formed of the first, the second and the third shutoff valves 4201, 4201 and 4203 and the cross-shaped channel 4301 makes it possible to select a destination to which the tube 4102 is linked, among the atmosphere, the buffer tank 3002 and the exchange tank 3001.

Furthermore, the pump 3007, which forces the application liquid and air to flow toward the buffer tank 3002 in this liquid channel 3002, is provided in the second channel including the tubes 4103 and 4104. The tube 4103 is linked to an upstream side of the pump 3007. On the other hand, the tube 4104 is linked to a downstream side of the pump 3007. This tube 4104 links the buffer tank 3002 and the pump 3007. The tube 4103 links the pump 3007 and the liquid collection port 2005.

By driving the pump 3007 with the buffer tank 3002 and the space-creating base 2002 (the liquid retention space S) being linked via these first and second channels, the application liquid can be supplied to the space-creating base 2002 while being circulated.

The tube 4106 included in the third channel is linked to the exchange tank 3001 through the first linking port 3005, shaped like an injection needle, and the pedestal 3003 constituting the linking channel. That is, the tube 4106 is linked to the exchange tank 3001 by causing the linking port 3005 shaped like an injection needle to penetrate the rubber 3501 provided to the bottom portion of the exchange tank 3001. The other opening of the tube 4106 is linked to the cross-shaped channel 4301. The tube 4106 is the first refilling channel in this embodiment for supplying the application liquid from the exchange tank 3001 to the buffer tank 3002.

The fourth channel includes tubes 4107 and 4108. The tube 4108 included in the fourth channel is linked to the exchange tank 3001 through the second linking port 3006 shaped like an injection needle and the pedestal 3003 constituting the linking channel. That is, the tube 4108 is linked to the exchange tank 3001 by causing the linking port 3006 shaped like an injection needle to penetrate the rubber 3502 provided to the bottom portion of the exchange tank 3001. The exchange tank 3001 communicates with the buffer tank 3002 through a fourth shutoff valve 4204 enabling the tube 4107 and the tube 4108 to switch between communication with and shutoff from each other.

Note that each of steps is the same as in the case with the first embodiment, and description on the steps will be omitted.

Additionally, settings of open-close combinations of the respective shutoff valves for the respective steps of "letting stand", "refilling", "circulation" and "collection" are shown in Table 2.

TABLE 2

| | First Shutoff Valve | Second Shutoff Valve | Third Shutoff Valve | Fourth Shutoff Valve |
|---|---|---|---|---|
| Letting stand | Open | Close | Close | Close |
| Refilling | Close | Close | Open | Open |
| Circulation | Close | Open | Close | Close |
| Collection | Open | Close | Close | Close |

In this embodiment, the number of the shutoff valves can be reduced by one from the number in the first embodiment. In this embodiment, when the application liquid is refilled from the exchange tank 3001 in the buffer tank 3002, the shutoff valves are caused to form the open-close combination for the "refilling." At this time, the refilled application liquid is, firstly, sent from the exchange tank 3001 to the liquid retention space S via the tubes 4106 and 4102, and subsequently, is refilled in the buffer tank 3002 via the tube 4103, the pump 3007 and the tube 4104.

Note that, although the circulation by the decompression method is performed in this embodiment by arranging the pump 3007 in the collection path of the application liquid (the second channel), the circulation by the compression method may be performed instead. In a case of performing the circulation by the compression method, it is only necessary to provide the pump 3007 in a section between the liquid supply port 2004 of the space-creating base 2002, and a confluence of the first and the second refilling channels (the cross-shaped channel 4301).

Note that, although, in this embodiment, the refilling of the application liquid from the exchange tank 3001 in the buffer tank 3002 is performed separately from the circulation of the application liquid through the liquid retention space S, the refilling and the circulation may be performed at the same time. In this case, it is only necessary to close the first shutoff valve 4201 and to open the second to the fourth shutoff valves 4202 to 4204.

Other Embodiments

Although the exchange tank 3001 is arranged inside the liquid application device in the first and the second embodiments, it is not the true nature of these embodiments that the exchange tank 3001 and the buffer tank 3002 are accommodated in a single device. What is important in an embodiment of the present invention is to reduce the number of pumps from that in the conventional device in the case of using the main tank and the buffer tank. Consequently, in an embodiment of the present invention, the exchange tank 3001 may be provided as a separate member from the liquid application device. That is, the exchange tank 3001 may be externally attached to the liquid application device.

Additionally, although the fourth channel is provided to the exchange tank 3001 instead of having an atmosphere communication port provided thereto in the first and the second embodiments, the present invention is not limited to this construction. The atmosphere communication port may be provided to the exchange tank 3001 instead of providing the fourth channel thereto. In this case, it is only necessary to provide a sensor for detecting the liquid surface level in order to manage the liquid surface level inside the buffer tank 3002.

Additionally, the exchange tank 3001 may be constructed as bag-type application liquid storage means instead of providing the fourth channel thereto.

Furthermore, although the exchange tank is used as the main tank in the first and the second embodiments, the present invention is not limited to this construction. A built-in tank to the liquid application device may be used as the main tank.

Embodiment of an Ink Jet Recording Apparatus

Figure 20:
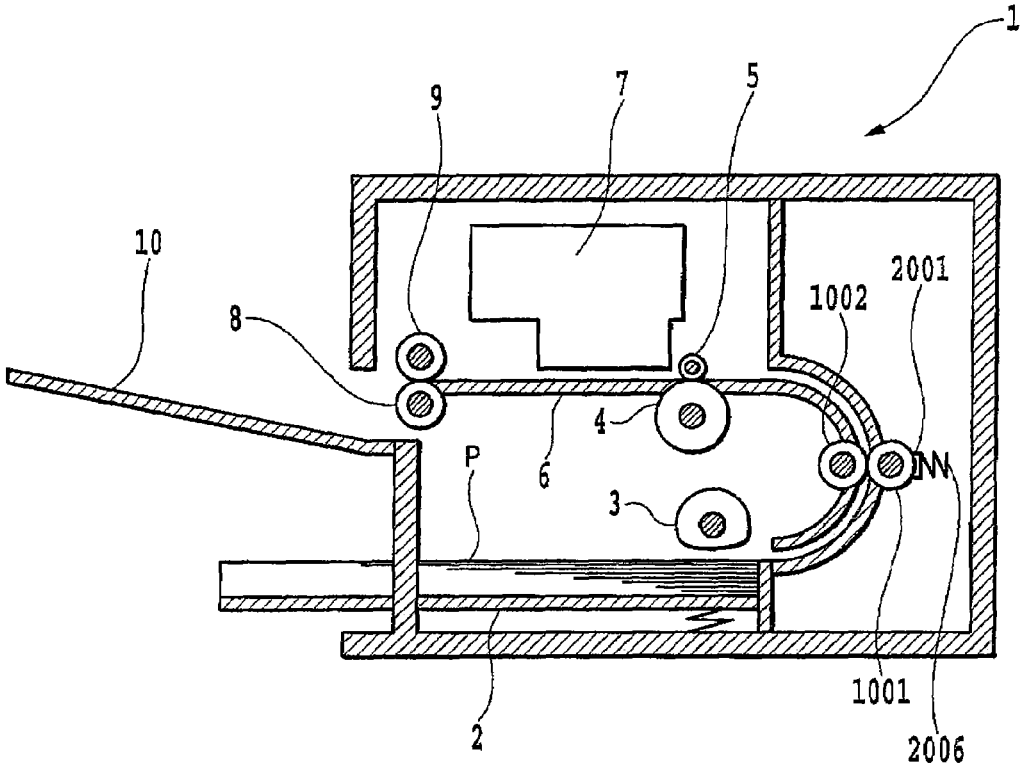
FIG. 20 is a longitudinal sectional side view showing a schematic configuration of an inkjet recording apparatus in the embodiment of the present invention.

FIG. 20 is a diagram showing a schematic configuration of the inkjet recording apparatus 1 including the application mechanism having almost the same configuration as that of the above liquid application device.

In the inkjet recording apparatus 1, provided is a feed tray 2 on which a plurality of recording media P are stacked, and a semi lunar shaped separation roller 3 separates the recording media P stacked on the feed tray one by one, and feeds each medium to a transfer path. In the transfer path, the application roller 1001 and the counter roller 1002 constituting the liquid application means of the liquid application mechanism are disposed. The recording medium P fed from the feed tray 2 is transferred to the interface between the rollers 1001 and 1002. The application roller 1001 is caused to rotate clockwise in FIG. 20 by the rotation of the roller drive motor, and applies the application liquid on the recording surface of the recording medium P while transferring the recording medium P. The recording medium P to which the application liquid has been applied is sent to the interface between a transfer roller 4 and a pinch roller 5. Subsequently, the counterclockwise (in this figure) rotation of the transfer roller 4 transfers the recording medium P on a platen 6, and moves the medium to a position facing a recording head 7 being an element of recording means. The recording head 7 is an inkjet recording head in which the predetermined number of nozzles for ejecting ink are arranged. While the recording head 7 scans the recording surface in a direction perpendicular to the plane of the drawing sheet, ink droplets are ejected from the nozzles to the recording surface of the recording medium P in accordance with the recorded data to perform recording. An image is formed on the recording medium while the recording operation and the transfer operation by a predetermined feed carried out by the transfer roller 4 are alternately repeated. With the image forming operation, the recording medium P is held between a sheet discharging roller 8 and a sheet discharging spur roller 9 provided downstream of the scanning region of the recording head in the transfer path of the recording media, and is discharged onto a sheet discharged tray 10 by the rotation of the sheet discharging roller 8.

As the inkjet recording apparatus, a so-called full-line type inkjet recording apparatus can be constructed, which performs the recording operation by using a long recording head which has ink-discharging nozzles arranged across the maximum width of the recording media.

The application liquid used in this embodiment is a treatment liquid for promoting the coagulation of pigment when the recording is carried out using an ink which contains pigment as a coloring material. With regard to this embodiment, the treatment liquid is used as the application liquid, so that the treatment liquid is allowed to react with the pigment as a coloring material in the ink ejected to the recording medium, to which the treatment liquid has been applied, to promote the coagulation of pigment. By promoting the coagulation of pigment, it is made possible to achieve the improvement of the recording density. In addition, it is also made possible to reduce or prevent bleeding. Needless to say, the application liquid used in the inkjet recording apparatus is not limited to the above example.

Figure 21:
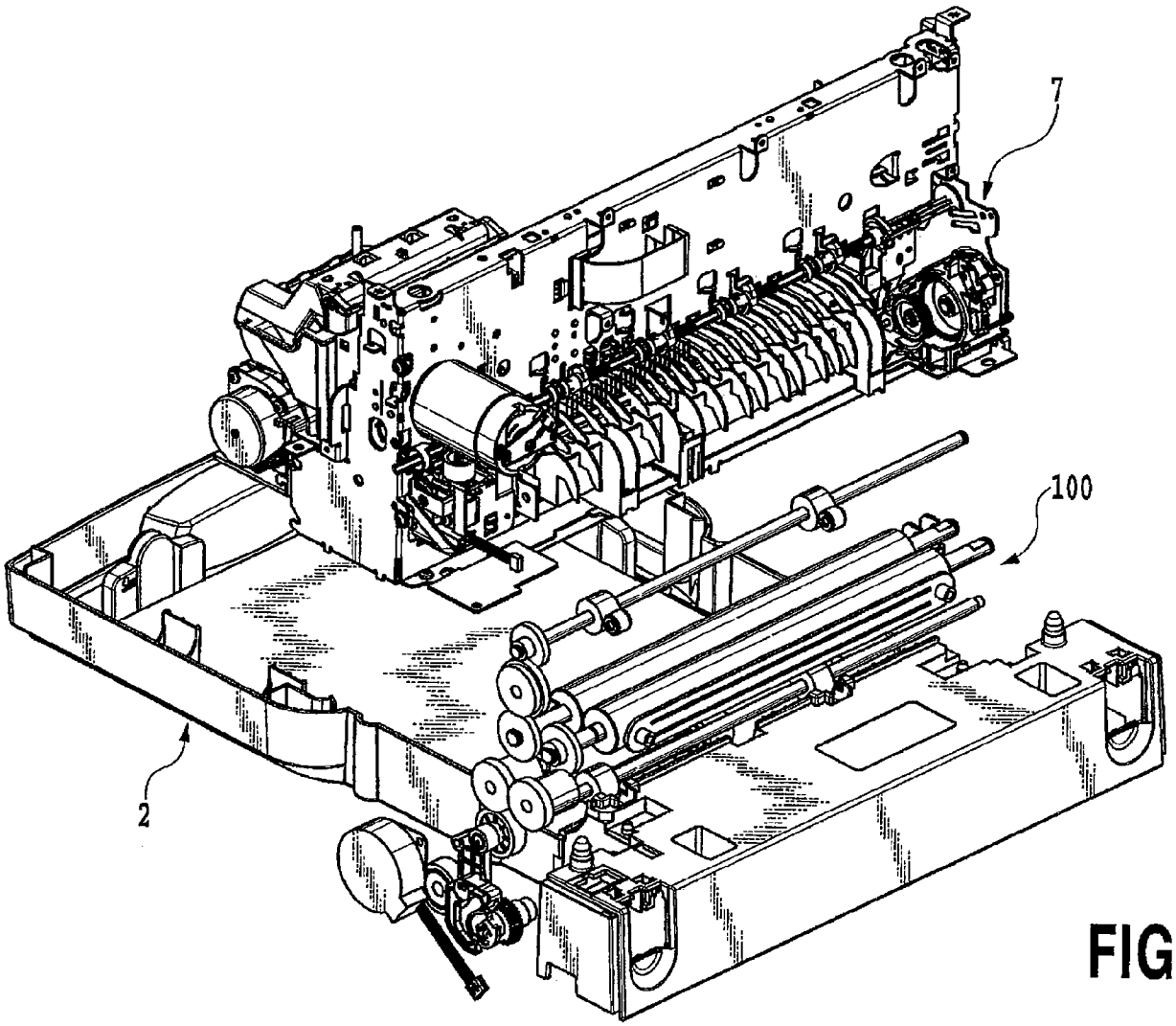
FIG. 21 is a perspective view showing a main part of the inkjet recording apparatus shown in FIG. 20.

FIG. 21 is a perspective view showing a main part of the above-described inkjet recording apparatus. As shown in this figure, an application mechanism 100 is provided above an edge of the feed tray 2, and the recording means including the recording head 7 is provided above the application mechanism and over a middle portion of the feed tray 2.

Figure 22:
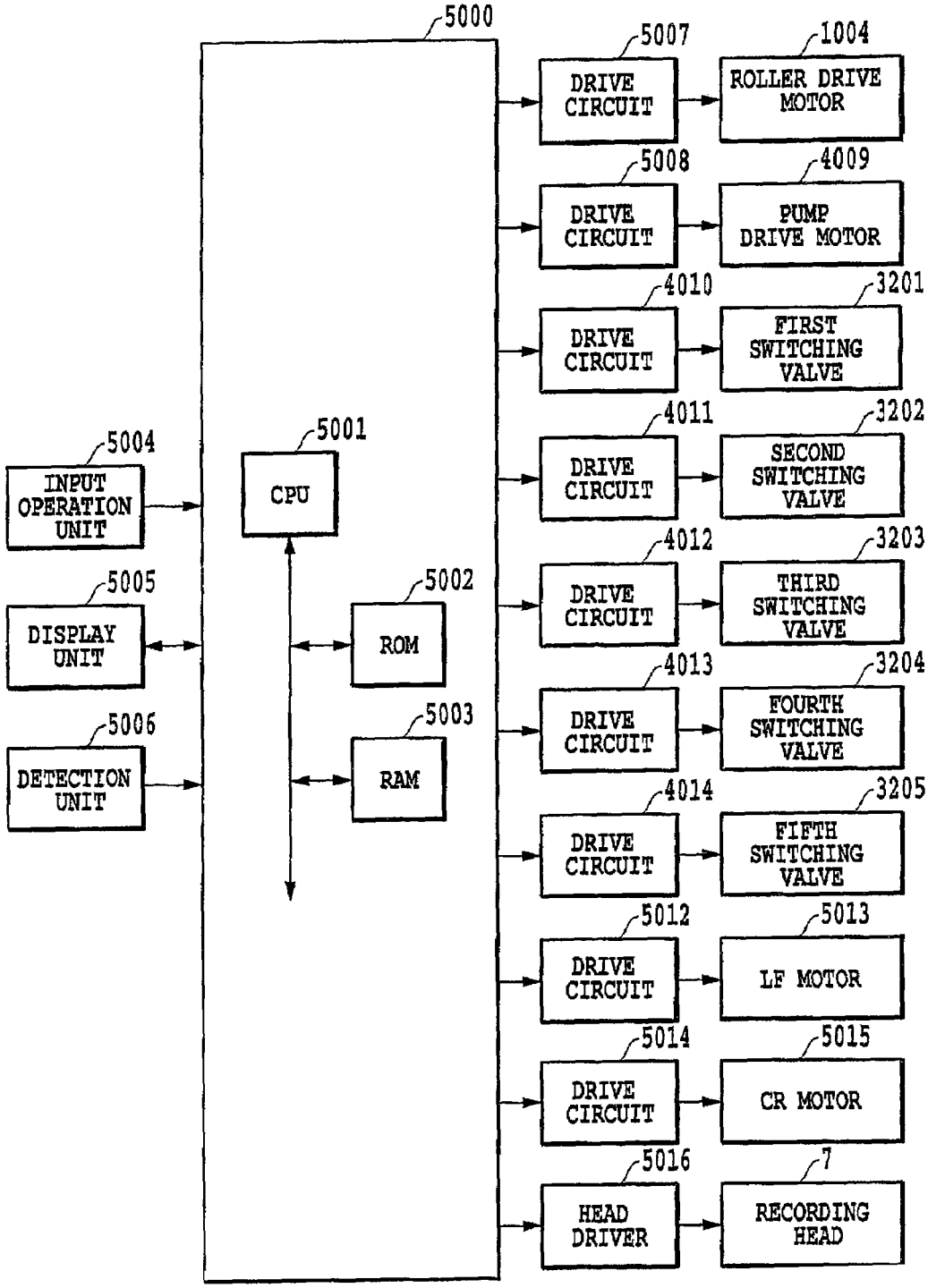
FIG. 22 is a block diagram showing a schematic configuration of a control system of the inkjet recording apparatus shown in FIG. 20.

FIG. 22 is a block diagram showing a control system of the above-described inkjet recording apparatus. In this figure, the roller drive motor 1004, the pump drive motor 4009, and the atmosphere communication valve 3005, which are elements of the liquid application mechanism, are the same elements as those described in connection with the above liquid application device.

A CPU 5001 controls the driving of each element of the application mechanism in accordance with the program of a procedure described later in connection with FIG. 23. The CPU 5001 also controls the driving of an LF motor 5013, a CR motor 5015 and the recording head 7, which are included in the recording means, via drive circuits 5012, 5014 and 5016, respectively. Specifically, the transfer roller 4, for example, is rotated by the driving of the LF motor 5013, and a carriage on which the recording head 7 is mounted is moved by the driving of the CR motor. The CPU 5001 also effects control of the ink discharge from the nozzles of the recording head.

Figure 23:
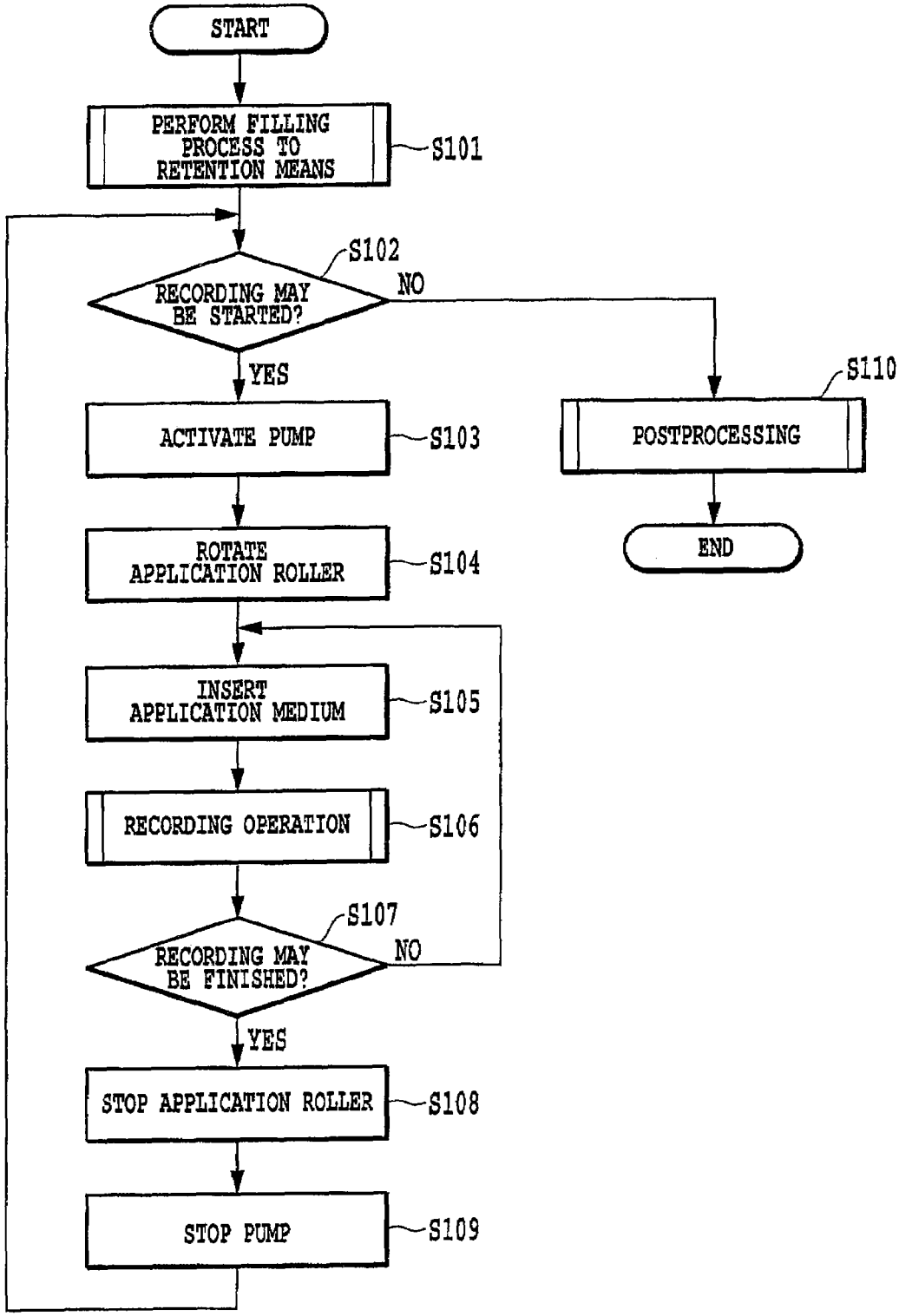
FIG. 23 is a flow chart showing a sequence of a liquid application operation and of a recording operation performed with the inkjet recording apparatus shown in FIG. 20.

FIG. 23 is a flow chart showing a procedure of the liquid application operation and the accompanying recording operation using the inkjet recording apparatus of this embodiment. In this figure, the processes in steps S101, S103 to S105, and steps S108 to S110 are the same as those in steps S1, S3 to S5, S7 to S9, respectively, shown in FIG. 13.

As shown in FIG. 23, in this embodiment, when a command to start the recording is received (step S102), a series of steps for liquid application are performed (steps S103 to S105).

After these application steps, performed is the recording operation onto the recording medium to which the application liquid has been applied over the part to which the application is required (step S106). Specifically, the recording head 7 is allowed to scan the recording medium P which is fed by a predetermined amount each time by the transfer roller 4, and ink is ejected from the nozzles in accordance with the recorded data during this scanning, so that the ink is allowed to stick to the recording medium to form dots. By repeating the above-described operation of transferring the recording medium and of scanning the recording head, recording on the recording medium P is carried out. The recording medium on which the recording is finished is delivered out onto the delivery tray 10. If it is judged in step S107 that the recording is finished, processes in step S108 and in later steps are performed, whereby this processing is ended.

In this embodiment, with the liquid being applied to a recording medium, the recording is performed successively onto the part of the recording medium to which the application has been completed. Specifically, with regard to this embodiment, the length of the transfer path from the application roller to the recording head is less than that of the recording medium, and, when the part of the recording medium to which the liquid has been applied reaches the scanning region of the recording head, the application to other part of the recording medium is performed by the application mechanism. The liquid application and the recording are successively performed in different parts of the recording medium every time the recording medium is fed by a predetermined amount. However, when the present invention is applied to recording apparatuses, another mode can be an apparatus which performs recording onto a recording medium after application to the recording medium has been completed, as described in Japanese Patent Application Laid-open No. 2002-96452.

Additionally, in the recording apparatus of the present invention, by using a liquid including a fluorescent whitening agent as the application liquid, it is possible to improve the whiteness of the media. In this case, the recording means used after the liquid application is not limited to that of the inkjet type. Effects can be obtained also when another recording type, such as the thermal-transfer type or the electrophotographic type, is adopted as the recording means.

In addition, as the application liquid, a sensitizer may be applied before recording in a recording apparatus of the silver-halide photographic type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-233272, filed Aug. 11, 2005, which is hereby incorporated by reference herein in its entirety.

What is claimed is:

1. An inkjet printing device comprising:

liquid application means including an application member for applying a liquid, which reacts with an ink, to a medium, and a retention member for retaining the liquid in contact with the application member, wherein the liquid application means applies the liquid retained in the retention member to the medium via the application member by rotating the application member;

a recording head for ejecting the ink to the medium to which the liquid has been applied by the liquid application means;

a first storage unit for storing the liquid;

a passage which causes the first storage unit and the retention member to communicate with each other;

a pump which circulates the liquid in a circulation channel including the first storage unit, the passage, and the retention member; and a second storage unit for storing the liquid to be supplied to the circulation channel, wherein the pump is provided along the passage and the liquid stored in the second storage unit is supplied to the circulation channel by the pump.

2. The inkjet printing device according to claim 1, wherein the passage includes a first passage for supplying the liquid in the first storage unit to the retention member and a second passage for returning the liquid in the retention member to the first storage unit, and the pump is provided along the second passage.

3. The inkjet printing device according to claim 2, further comprising a third passage which causes the second storage unit and the second passage to communicate with each other, wherein the liquid stored in the second storage unit is supplied via the third passage.

4. The inkjet printing device according to claim 3, further comprising switching means for enabling to selectively establish a communication state between the second storage unit and the second passage, and bring a shutoff state between the second storage unit and the second passage, wherein the switching means is arranged in provided within the third passage.

5. The inkjet printing device according to claim 3, further comprising a fourth passage which causes the first storage unit and the second storage unit to communicate with each other.

6. The inkjet printing device according to claim 5, wherein the liquid stored in the first storage unit is collected into the second storage unit via the fourth passage.

7. The inkjet printing device according to claim 5, wherein an end portion of the fourth passage inside the first storage unit is positioned to be higher in a gravitational direction than an end portion of the first passage inside the first storage unit.

8. The inkjet printing device according to claim 5, wherein the second storage unit is hermetically closed except for linking portions thereof with the third and the fourth passages.

9. The inkjet printing device according to claim 2, further comprising a third passage which causes the second storage unit and the first passage to communicate with each other, wherein the liquid stored in the second storage unit is supplied via the third passage.

10. The liquid application device according to claim 1, wherein the second storage unit is exchangeable.

* * * * *